US007562021B2

(12) United States Patent
Mehrotra et al.

(10) Patent No.: US 7,562,021 B2
(45) Date of Patent: Jul. 14, 2009

(54) MODIFICATION OF CODEWORDS IN DICTIONARY USED FOR EFFICIENT CODING OF DIGITAL MEDIA SPECTRAL DATA

(75) Inventors: Sanjeev Mehrotra, Kirkland, WA (US); Wei-Ge Chen, Sammamish, WA (US); Kazuhito Koishida, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 411 days.

(21) Appl. No.: 11/183,084

(22) Filed: Jul. 15, 2005

(65) Prior Publication Data

US 2007/0016414 A1 Jan. 18, 2007

(51) Int. Cl.
*G10L 19/00* (2006.01)

(52) U.S. Cl. ..... 704/500; 704/219; 704/221; 375/246; 375/262

(58) Field of Classification Search ..... 704/300, 704/221, 224, 230, 500, 501, 503, 504, 203, 704/219; 375/246, 262
See application file for complete search history.

(56) References Cited

U.S. PATENT DOCUMENTS 5,040,217 A 8/1991 Brandenburg et al.
5,079,547 A 1/1992 Fuchigama et al.
5,260,980 A 11/1993 Akagiri et al.
5,295,203 A * 3/1994 Krause et al. ..... 382/248
5,388,181 A 2/1995 Anderson et al.
5,438,643 A 8/1995 Akagiri et al.
5,455,874 A 10/1995 Ormsby et al.
5,539,829 A 7/1996 Lokhoff et al.
5,581,653 A 12/1996 Todd
5,627,938 A 5/1997 Johnston
5,640,486 A * 6/1997 Lim ..... 704/206
5,654,702 A 8/1997 Ran
5,661,755 A 8/1997 Van De Kerkhof et al.
5,682,461 A 10/1997 Silzle et al.
5,686,964 A 11/1997 Tabatabai et al.
5,737,720 A 4/1998 Miyamori et al.
5,777,678 A 7/1998 Ogata et al.
5,819,214 A 10/1998 Suzuki et al.
5,845,243 A 12/1998 Smart et al.

(Continued)

FOREIGN PATENT DOCUMENTS

EP 0663740 7/1995

(Continued)

OTHER PUBLICATIONS

Search Report from PCT/US06/27420, dated Apr. 26, 2007.

(Continued)

*Primary Examiner*—Daniel D Abebe
(74) *Attorney, Agent, or Firm*—Klarquist Sparkman, LLP

(57) ABSTRACT

Coding of spectral data by representing certain portions of the spectral data as a scaled version of a code-vector, where the code-vector is chosen from either a fixed predetermined codebook or a codebook taken from a baseband. Various optional features are described for modifying the code-vectors in the codebook according to some rules which allow the code-vector to better represent the data they are modeling. The code-vector modification comprises a linear or non-linear transform of one or more code-vectors, such as, by exponentiation, negation, reversing, or combining elements from plural code-vectors.

19 Claims, 12 Drawing Sheets

U.S. PATENT DOCUMENTS

| | | | | |
|---|---|---|---|---|
| 5,852,806 | A | 12/1998 | Johnston et al. | |
| 5,870,480 | A | 2/1999 | Griesinger | |
| 5,886,276 | A | 3/1999 | Levine et al. | |
| 5,956,674 | A | 9/1999 | Smyth et al. | |
| 5,995,151 | A | 11/1999 | Naveen et al. | |
| 6,021,386 | A | 2/2000 | Davis et al. | |
| 6,029,126 | A | 2/2000 | Malvar | |
| 6,058,362 | A | 5/2000 | Malvar | |
| 6,115,688 | A | 9/2000 | Brandenburg et al. | |
| 6,115,689 | A | 9/2000 | Malvar | |
| 6,122,607 | A | 9/2000 | Ekudden et al. | |
| 6,182,034 | B1 | 1/2001 | Malvar | |
| 6,226,616 | B1 | 5/2001 | You et al. | |
| 6,230,124 | B1 * | 5/2001 | Maeda | 704/227 |
| 6,240,380 | B1 | 5/2001 | Malvar | |
| 6,341,165 | B1 | 1/2002 | Gbur et al. | |
| 6,393,392 | B1 | 5/2002 | Minde | |
| 6,449,596 | B1 | 9/2002 | Ejima | |
| 6,498,865 | B1 | 12/2002 | Brailean et al. | |
| 6,601,032 | B1 * | 7/2003 | Surucu | 704/500 |
| 6,680,972 | B1 | 1/2004 | Liljeryd | |
| 6,735,567 | B2 | 5/2004 | Gao et al. | |
| 6,760,698 | B2 | 7/2004 | Gao | |
| 6,766,293 | B1 | 7/2004 | Herre et al. | |
| 6,771,777 | B1 | 8/2004 | Gbur et al. | |
| 6,778,709 | B1 | 8/2004 | Taubman | |
| 6,804,643 | B1 * | 10/2004 | Kiss | 704/234 |
| 6,882,731 | B2 | 4/2005 | Irwan et al. | |
| 6,934,677 | B2 | 8/2005 | Chen et al. | |
| 6,999,512 | B2 | 2/2006 | Yoo et al. | |
| 7,010,041 | B2 | 3/2006 | Graziani et al. | |
| 7,043,423 | B2 | 5/2006 | Vinton et al. | |
| 7,062,445 | B2 | 6/2006 | Kadatch | |
| 7,107,211 | B2 | 9/2006 | Griesinger | |
| 7,193,538 | B2 | 3/2007 | Craven et al. | |
| 7,310,598 | B1 * | 12/2007 | Mikhael et al. | 704/230 |
| 2001/0017941 | A1 | 8/2001 | Chaddha | |
| 2003/0093271 | A1 * | 5/2003 | Tsushima et al. | 704/230 |
| 2003/0115041 | A1 | 6/2003 | Chen et al. | |
| 2003/0115042 | A1 | 6/2003 | Chen et al. | |
| 2003/0115050 | A1 | 6/2003 | Chen et al. | |
| 2003/0115051 | A1 | 6/2003 | Chen et al. | |
| 2003/0115052 | A1 | 6/2003 | Chen et al. | |
| 2003/0193900 | A1 | 10/2003 | Zhang et al. | |
| 2003/0233234 | A1 | 12/2003 | Truman et al. | |
| 2003/0233236 | A1 | 12/2003 | Davidson et al. | |
| 2003/0236580 | A1 | 12/2003 | Wilson et al. | |
| 2004/0044527 | A1 | 3/2004 | Thumpudi et al. | |
| 2004/0133423 | A1 | 7/2004 | Crockett | |
| 2004/0165737 | A1 | 8/2004 | Monro | |
| 2004/0243397 | A1 | 12/2004 | Averty et al. | |
| 2005/0065780 | A1 | 3/2005 | Wiser et al. | |
| 2005/0074127 | A1 | 4/2005 | Herre et al. | |
| 2005/0108007 | A1 | 5/2005 | Bessette et al. | |
| 2005/0149322 | A1 | 7/2005 | Bruhn et al. | |
| 2005/0159941 | A1 | 7/2005 | Kolesnik et al. | |
| 2005/0165611 | A1 | 7/2005 | Mehrotra et al. | |
| 2005/0195981 | A1 | 9/2005 | Faller et al. | |
| 2006/0004566 | A1 | 1/2006 | Oh et al. | |
| 2006/0025991 | A1 | 2/2006 | Kim | |
| 2006/0074642 | A1 | 4/2006 | You | |
| 2006/0095269 | A1 | 5/2006 | Smith et al. | |
| 2006/0106597 | A1 | 5/2006 | Stein | |
| 2006/0140412 | A1 | 6/2006 | Villemoes et al. | |
| 2007/0016406 | A1 | 1/2007 | Thumpudi et al. | |
| 2007/0016415 | A1 | 1/2007 | Thumpudi et al. | |
| 2007/0016427 | A1 | 1/2007 | Thumpudi et al. | |
| 2007/0036360 | A1 | 2/2007 | Breebaart | |
| 2007/0063877 | A1 | 3/2007 | Shmunk et al. | |
| 2007/0127733 | A1 | 6/2007 | Henn et al. | |
| 2008/0052068 | A1 * | 2/2008 | Aguilar et al. | 704/230 |

FOREIGN PATENT DOCUMENTS

| | | |
|---|---|---|
| EP | 0910927 | 4/1999 |
| EP | 0931386 | 7/1999 |
| EP | 1396841 | 3/2004 |
| EP | 1783745 A1 | 5/2007 |
| WO | 02/43054 | 5/2002 |

OTHER PUBLICATIONS

U.S. Appl. No. 10/882,801, filed Jun. 29, 2004, Chen et al.

Search Report from PCT/US04/24935, dated Feb. 24, 2005.

Advanced Television Systems Committee, *ATSC Standard: Digital Audio Compression (AC-3), Revision A*, 140 pp. (1995).

Brandenburg, "ASPEC Coding", *AES 10th International Conference*, pp. 81-90 (1991).

"ISO/IEC 11172-3, Information Technology—Coding of Moving Pictures and Associated Audio for Digital Storage Media at Up to About 1.5 Mbit/s—Part 3: Audio," 154 pp. (1993).

"ISO/IEC 13818-7, Information Technology—Generic Coding of Moving Pictures and Associated Audio Information—Part 7: Advanced Audio Coding (AAC)," 174 pp. (1997).

"ISO/IEC 13818-7, Information Technology—Generic Coding of Moving Pictures and Associated Audio Information—Part 7: Advanced Audio Coding (AAC), Technical Corrigendum 1" 22 pp. (1998).

ITU, Recommendation ITU-R BS 1115, Low Bit-Rate Audio Coding, 9 pp. (1994).

Hasegawa-Johnson et al., "Speech coding: fundamentals and applications," *Handbook of Telecommunications*, John Wiley and Sons, Inc., pp. 1-33 (2003). [available at http://citeseer.ist.psu.edu/617093.html].

Najafzadeh-Azghandi et al., "Perceptual coding of narrowband audio signals at 8 Kbit/s" (1997), available at http://citeseer.ist.psu.edu/najafzadeh-azghandi97perceptual.html.

Painter et al., "Perceptual Coding Of Digital Audio," *Proceedings Of The IEEE*, vol. 88, Issue 4, pp. 451-515, Apr. 2000, available at http://www.eas.asu.edu/~spanias/papers/paper-audio-tedspanias-00.pdf.

Schroeder et al., "Code-excited linear prediction (CELP): High-quality speech at very low bit rates," *Proc. IEEE Int. Conf ASSP*, pp. 937-940, 1985.

Schulz, "Improving audio codecs by noise substitution," *Journal Of The AES*, vol. 44, No. 7/8, pp. 593-598, Jul./Aug. 1996.

Sporer et al., "The Use of Multirate Filter Banks for Coding of High Quality Digital Audio," *6th European Signal Processing Conference (EUSIPCO)*, Amsterdam, vol. 1, pp. 211-214, Jun. 1992.

Search Report from PCT/US06/27238, dated Aug. 15, 2007.

Beerends, "Audio Quality Determination Based on Perceptual Measurement Techniques," Applications of Digital Signal Processing to Audio and Acoustics, Chapter 1, Ed. Mark Kahrs, Karlheinz Brandenburg, Kluwer Acad. Publ., pp. 1-38 (1998).

Caetano et al., "Rate Control Strategy for Embedded Wavelet Video Coders," Electronics Letters, pp. 1815-1817 (Oct. 14, 1999).

De Luca, "AN1090 Application Note: STA013 MPEG 2.5 Layer III Source Decoder," STMicroelectronics, 17 pp. (1999).

de Queiroz et al., "Time-Varying Lapped Transforms and Wavelet Packets," IEEE Transactions on Signal Processing, vol. 41, pp. 3293-3305 (1993).

Dolby Laboratories, "AAC Technology," 4 pp. [Downloaded from the web site aac-audio.com on World Wide Web on Nov. 21, 2001.].

Faller et al., "Binaural Cue Coding Applied to Stereo and Multi-Channel Audio Compression," Audio Engineering Society, Presented at the 112th Convention, May 2002, 9 pages.

Fraunhofer-Gesellschaft, "MPEG Audio Layer-3," 4 pp. [Downloaded from the World Wide Web on Oct. 24, 2001.].

Fraunhofer-Gesellschaft, "MPEG-2 AAC," 3 pp. [Downloaded from the World Wide Web on Oct. 24, 2001.].

Gibson et al., Digital Compression for Multimedia, Title Page, Contents, "Chapter 7: Frequency Domain Coding," Morgan Kaufman Publishers, Inc., pp. iii, v-xi, and 227-262 (1998).

Herley et al., "Tilings of the Time-Frequency Plane: Construction of Arbitrary Orthogonal Bases and Fast Tiling Algorithms," IEEE Transactions on Signal Processing, vol. 41, No. 12, pp. 3341-3359 (1993).
Herre et al., "MP3 Surround: Efficient and Compatible Coding of Multi-Channel Audio," 116th Audio Engineering Society Convention, 2004, 14 pages.
ITU, Recommendation ITU-R BS 1387, Method for Objective Measurements of Perceived Audio Quality, 89 pp. (1998).
Jesteadt et al., "Forward Masking as a Function of Frequency, Masker Level, and Signal Delay," Journal of Acoustical Society of America, 71:950-962 (1982).
A.M. Kondoz, Digital Speech: Coding for Low Bit Rate Communications Systems, "Chapter 3.3: Linear Predictive Modeling of Speech Signals" and "Chapter 4: LPC Parameter Quantisation Using LSFs," John Wiley & Sons, pp. 42-53 and 79-97 (1994).
Korhonen et al., "Schemes for Error Resilient Streaming of Perceptually Coded Audio," Proceedings of the 2003 IEEE International Conference on Acoustics, Speech & Signal Processing, 2003, pp. 165-168.
Lau et al., "A Common Transform Engine for MPEG and AC3 Audio Decoder," IEEE Trans. Consumer Electron., vol. 43, Issue 3, Jun. 1997, pp. 559-566.
Lufti, "Additivity of Simultaneous Masking," Journal of Acoustic Society of America, 73:262-267 (1983).
Malvar, "Biorthogonal and Nonuniform Lapped Transforms for Transform Coding with Reduced Blocking and Ringing Artifacts," appeared in IEEE Transactions on Signal Processing, Special Issue on Multirate Systems, Filter Banks, Wavelets, and Applications, vol. 46, 29 pp. (1998).
H.S. Malvar, "Lapped Transforms for Efficient Transform/Subband Coding," IEEE Transactions on Acoustics, Speech and Signal Processing, vol. 38, No. 6, pp. 969-978 (1990).
H.S. Malvar, *Signal Processing with Lapped Transforms*, Artech House, Norwood, MA, pp. iv, vii-xi, 175-218, 353-357 (1992).
Noll, "Digital Audio Coding for Visual Communications," Proceedings of the IEEE, vol. 83, No. 6, Jun. 1995, pp. 925-943.
OPTICOM GmbH, "Objective Perceptual Measurement," 14 pp. [Downloaded from the World Wide Web on Oct. 24, 2001.].
Painter et al., "A Review of Algorithms for Perceptual Coding of Digital Audio Signals," Digital Signal Processing Proceedings, 1997, 30 pp.
Phamdo, "Speech Compression," 13 pp. [Downloaded from the World Wide Web on Nov. 25, 2001.].
Ribas Corbera et al., "Rate Control in DCT Video Coding for Low-Delay Communications," IEEE Transactions on Circuits and Systems for Video Technology vol. 9, No. 1, pp. 172-185 (Feb. 1999).
Rijkse, "H.263: Video Coding for Low-Bit-Rate Communication," IEEE Comm., vol. 34, No. 12, Dec. 1996, pp. 42-45.
Scheirer, "The MPEG-4 Structured Audio standard," Proc 1998 IEEE ICASSP, 1998, pp. 3801-3804.
Seymour Shlien, "The Modulated Lapped Transform, Its Time-Varying Forms, and Its Application to Audio Coding Standards," IEEE Transactions on Speech and Audio Processing, vol. 5, No. 4, pp. 359-366 (Jul. 1997).
Solari, Digital Video and Audio Compression, Title Page, Contents, "Chapter 8: Sound and Audio," McGraw-Hill, Inc., pp. iii, v-vi, and 187-211 (1997).
Srinivasan et al., "High-Quality Audio Compression Using an Adaptive Wavelet Packet Decomposition and Psychoacoustic Modeling," IEEE Transactions on Signal Processing, vol. 46, No. 4, pp. 1085-1093 (Apr. 1998).
Terhardt, "Calculating Virtual Pitch," Hearing Research, 1:155-182 (1979).
Todd et. al., "AC-3: Flexible Perceptual Coding for Audio Transmission and Storage," 96th Conv. of AES, Feb. 1994, 16 pp.
Tucker, "Low bit-rate frequency extension coding," IEEE Colloquium on Audio and Music Technology, Nov. 1998, 5 pages.
Wragg et al., "An Optimised Software Solution for an ARM PoweredTM MP3 Decoder," 9 pp. [Downloaded from the World Wide Web on Oct. 27, 2001.].
Yang et al., "Progressive Syntax-Rich Coding of Multichannel Audio Sources," EURASIP Journal of Applied Signal Processing, 2003, pp. 980-992.
Zwicker et al., Das Ohr als Nachrichtenempfänger, Title Page, Table of Contents, "I: Schallschwingungen," Index, Hirzel-Verlag, Stuttgart, pp. III, IX-XI, 1-26 and 231-232 (1967).
Zwicker, Psychoakustik, Title Page, Table of Contents, "Teil I: Einfuhrung," Index, Springer-Verlag, Berlin Heidelberg, New York, pp. II, IX-XI, 1-30, and 157-162 (1982).
International Search Report and Written Opinion for PCT/US06/27420, dated Apr. 26, 2007 8 pages.

* cited by examiner

MODIFICATION OF CODEWORDS IN DICTIONARY USED FOR EFFICIENT CODING OF DIGITAL MEDIA SPECTRAL DATA

TECHNICAL FIELD

The technology relates generally to coding of spectral data by representing certain portions of the spectral data as modified versions of other previously coded portions.

BACKGROUND

The coding of audio utilizes coding techniques that exploit various perceptual models of human hearing. For example, many weaker tones near strong ones are masked so they do not need to be coded. In traditional perceptual audio coding, this is exploited as adaptive quantization of different frequency data. Perceptually important frequency data are allocated more bits and thus finer quantization and vice versa.

Perceptual coding, however, can be taken to a broader sense. For example, some parts of the spectrum can be coded with appropriately shaped noise. When taking this approach, the coded signal may not aim to render an exact or near exact version of the original. Rather the goal is to make it sound similar and pleasant when compared with the original.

All these perceptual effects can be used to reduce the bit-rate needed for coding of audio signals. This is because some frequency components do not need to be accurately represented as present in the original signal, but can be either not coded or replaced with something that gives the same perceptual effect as in the original.

SUMMARY

An audio encoding/decoding technique described herein utilizes the fact that some frequency components can be perceptually well, or partially, represented using shaped noise, or shaped versions of other frequency components, or the combination of both. More particularly, some frequency bands can be perceptually well represented as a shaped version of other bands that have already been coded. Even though the actual spectrum might deviate from this synthetic version, it is still a perceptually good representation that can be used to significantly lower the bit-rate of the audio signal encoding without reducing quality.

Various optional features are described for modifying the code-vectors (e.g., codewords) in the codebook according to some rules which allow the code-vector to better represent sub-band data. The modification can consist of either a linear or non-linear transform, or by representing the code-vector as a combination of two other code-vectors. In the case of a combination, the modification can be provided by taking portions of one code-vector and combining it with portions of other code-vectors.

A codeword is from a baseband, a fixed codebook, and/or a randomly generated codeword. Additionally, a codeword can also be from a band that was previously coded by either a baseband coder or extended band coder. References to codewords herein, include all of these potential sources for codewords, although any particular embodiment may only use a subset of these sources for codewords. Various linear or non-linear transformations are performed on one or more codewords in a library to obtain a greater or more diverse set of shapes for identifying a best shape for matching a vector being coded. In one example, a codeword is reversed in coefficient order to obtain another codeword for shape matching.

In another example, a codeword's variance is reduced using exponentiation of coefficients with an exponent less than one. Similarly, a codeword's variance is exaggerated using an exponent greater than one. In another example, the coefficients of a codeword are negated. Of course, many other linear and non-linear transformations can be performed on one or more codewords in order to provide a larger or more diverse universe for matching sub-bands, or other vectors.

In another example, an exhaustive search is performed along a baseband and/or other codebooks to find a best match codeword. For example, a search is performed comprising an exhaustive search of a codeword library, including all combinations of exponential transform (p=0.5, 1.0, 2.0), sign transform (+/−), and direction transform (forward/reverse). Similarly, this exhaustive search may be performed along the noise codebook spectrum, other codebooks, or random noise vectors.

In general, a close match can be provided by determining a lowest variance between the sub-band being coded and a transformed codeword. An identifier of the codeword and transform, along with other information such as a scale factor, is coded in the bitstream and provided to the decoder.

In another example, two or more codewords are combined to provide a model for encoding. For example, two codewords b and n, are provided $b=<b_0, b_1 \ldots b_u>$ and $n=<n_0, n_1 \ldots n_u>$ to better describe a sub-band being coded. Vector b may be from the baseband, a noise codebook, or a library, and vector n may similarly be from any such source. A rule is provided for interleaving coefficients from each two or more codewords b and n, such that the decoder implicitly or explicitly knows which coefficient to take from the codewords b and n. The rule may be provided in the bitstream or may be known by the decoder implicitly. Alternatively, "b" may be the actual coding using waveform coding instead of a codeword.

Thus, an encoder can send two or more codeword identifiers, and optionally, a rule to decode which coefficients to take to create the sub-band. The encoder will also send scale factor information for codewords, and optionally if relevant, any other codeword transform information.

Additional features and advantages of the invention will be made apparent from the following detailed description of embodiments that proceeds with reference to the accompanying drawings.

DETAILED DESCRIPTION

Figure 1:
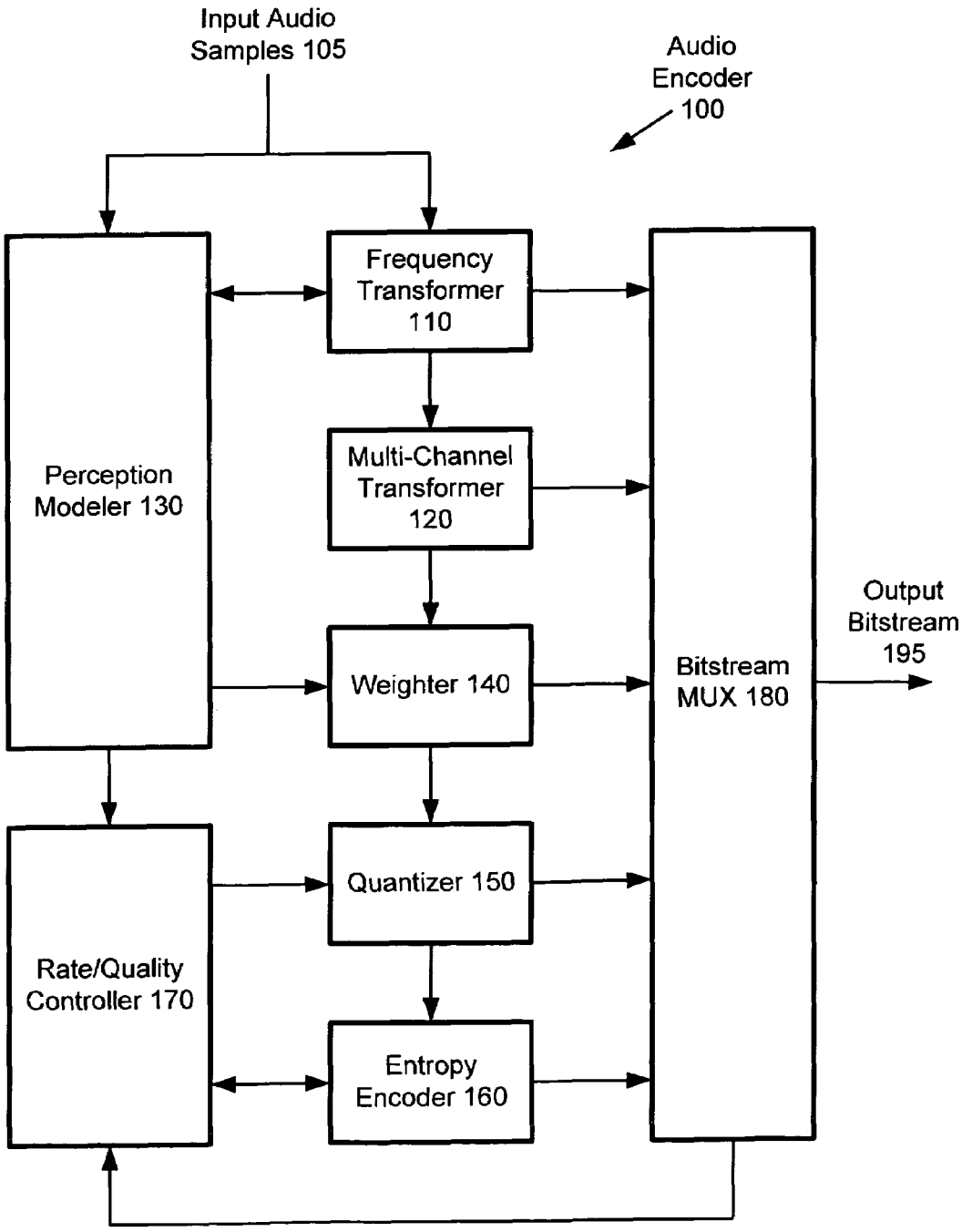
FIGS. 1 and 2 are a block diagram of an audio encoder and decoder in which the present coding techniques may be incorporated.

The following detailed description addresses audio encoder/decoder embodiments with audio encoding/decoding of audio spectral data using modification of codewords and/or modification of a default frequency segmentation. This audio encoding/decoding represents some frequency components using shaped noise, or shaped versions of other frequency components, or the combination of both. More particularly, some frequency bands are represented as a shaped version or transformation of other bands. This often allows a reduction in bit-rate at a given quality or an improvement in quality at a given bit-rate. Optionally, an initial sub-band frequency configuration can be modified based on tonality, energy, or shape of the audio data.

Brief Overview

In the patent application, "Efficient coding of digital media spectral data using wide-sense perceptual similarity," U.S. patent application Ser. No. 10/882,801, filed Jun. 29, 2004, an algorithm is provided which allows the coding of spectral data by representing certain portions of the spectral data as a scaled version of a code-vector, where the code-vector is chosen from either a fixed predetermined codebook (e.g., a noise codebook), or a codebook taken from a baseband (e.g., a baseband codebook). When the codebook is adaptively created, it can consist of previously encoded spectral data.

Various optional features are described for modifying the code-vectors in the codebook according to some rules which allow the code-vector to better represent the data they are representing. The modification can consist of either a linear or non-linear transform, or representing the code-vector as a combination of two or more other original or modified code-vectors. In the case of a combination, the modification can be provided by taking portions of one code-vector and combining it with portions of other code-vectors.

When using code-vector modification, bits have to be sent so that the decoder can apply the transformation to form a new code-vector. Despite the additional bits, codeword modification is still a more efficient coding to represent portions of the spectral data than actual waveform coding of that portion.

The described technology relates to improving the quality of audio coding, and can also be applied to other coding of multimedia such as images, video, and voice. A perceptual improvement is available when coding audio, especially when the portion of the spectrum used to form the codebook (typically the lowband) has different characteristics than the portion being coded using that codebook (typically the highband). For example, if the lowband is "peaky" and thus has values which are far from the mean, and the highband is not, or vice-versa, then this technique can be used to better code the highband using the lowband as a codebook.

A vector is a sub-band of spectral data. If sub-band sizes are variable for a given implementation, this provides the opportunity to size sub-bands to improve coding efficiency. Often, sub-bands which have similar characteristics may be merged with very little effect on quality, whereas sub-bands with highly variable data may be better represented if a sub-band is split. Various methods are described for measuring tonality, energy, or shape of a sub-band. These various measurements are discussed in light of making decisions of when to split or merge sub-bands. However, smaller (split) sub-bands require more sub-bands to represent the same spectral data. Thus, the smaller sub-band sizes require more bits to code the information. In cases when variable sub-band sizes are employed, a sub-band configuration is provided for efficient coding of the spectral data, while considering both the data required to code the sub-bands and the data required to send the sub-band configuration to a decoder. The following paragraphs proceed through more generalized examples to more specific examples.

Generalized Audio Encoder and Decoder

Figure 2:
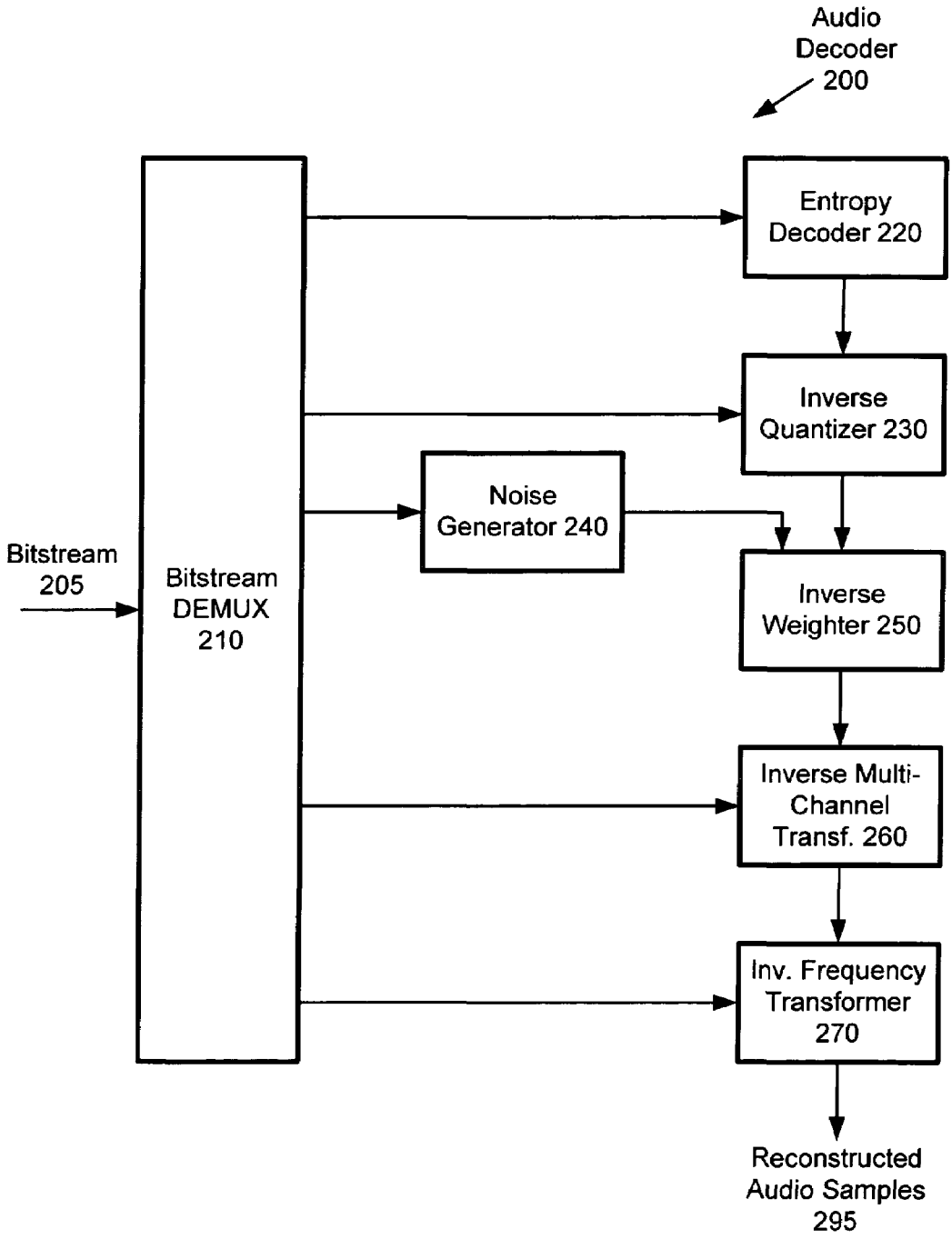

FIGS. 1 and 2 are block diagrams of a generalized audio encoder (100) and generalized audio decoder (200), in which the herein described techniques for audio encoding/decoding of audio spectral data using modification of codewords and/or modifications of an initial frequency segmentation. The relationships shown between modules within the encoder and decoder indicate the main flow of information in the encoder and decoder; other relationships are not shown for the sake of simplicity. Depending on implementation and the type of compression desired, modules of the encoder or decoder can be added, omitted, split into multiple modules, combined with other modules, and/or replaced with like modules. In alternative embodiments, encoders or decoders with different modules and/or other configurations of modules measure perceptual audio quality.

Further details of an audio encoder/decoder in which the wide-sense perceptual similarity audio spectral data encoding/decoding can be incorporated are described in the following U.S. patent applications: U.S. patent application Ser. No. 10/882,801, filed Jun. 29, 2004; U.S. patent application Ser. No. 10/020,708, filed Dec. 14, 2001; U.S. patent application Ser. No. 10/016,918, filed Dec. 14, 2001; U.S. patent application Ser. No. 10/017,702, filed Dec. 14, 2001; U.S. patent application Ser. No. 10/017,861, filed Dec. 14, 2001; and U.S. patent application Ser. No. 10/017,694, filed Dec. 14, 2001.

Exemplary Generalized Audio Encoder

The generalized audio encoder (100) includes a frequency transformer (110), a multi-channel transformer (120), a perception modeler (130), a weighter (140), a quantizer (150), an entropy encoder (160), a rate/quality controller (170), and a bitstream multiplexer ["MUX"] (180).

The encoder (100) receives a time series of input audio samples (105). For input with multiple channels (e.g., stereo mode), the encoder (100) processes channels independently, and can work with jointly coded channels following the multi-channel transformer (120). The encoder (100) compresses the audio samples (105) and multiplexes information produced by the various modules of the encoder (100) to output a bitstream (195) in a format such as Windows Media Audio ["WMA"] or Advanced Streaming Format ["ASF"]. Alternatively, the encoder (100) works with other input and/or output formats.

The frequency transformer (110) receives the audio samples (105) and converts them into data in the frequency domain. The frequency transformer (110) splits the audio samples (105) into blocks, which can have variable size to allow variable temporal resolution. Small blocks allow for greater preservation of time detail at short but active transition segments in the input audio samples (105), but sacrifice some frequency resolution. In contrast, large blocks have better frequency resolution and worse time resolution, and usually allow for greater compression efficiency at longer and less active segments. Blocks can overlap to reduce perceptible discontinuities between blocks that could otherwise be introduced by later quantization. The frequency transformer (110) outputs blocks of frequency coefficient data to the multi-channel transformer (120) and outputs side information such as block sizes to the MUX (180). The frequency transformer (110) outputs both the frequency coefficient data and the side information to the perception modeler (130).

The frequency transformer (110) partitions a frame of audio input samples (105) into overlapping sub-frame blocks with time-varying size and applies a time-varying MLT to the sub-frame blocks. Exemplary sub-frame sizes include 128, 256, 512, 1024, 2048, and 4096 samples. The MLT operates like a DCT modulated by a time window function, where the window function is time varying and depends on the sequence of sub-frame sizes. The MLT transforms a given overlapping block of samples x[n], $0 \leqq n < subframe_size$ into a block of frequency coefficients X[k], $0 \leqq k < subframe_size/2$. The frequency transformer (110) can also output estimates of the complexity of future frames to the rate/quality controller (170). Alternative embodiments use other varieties of MLT. In still other alternative embodiments, the frequency transformer (110) applies a DCT, FFT, or other type of modulated or non-modulated, overlapped or non-overlapped frequency transform, or use sub-band or wavelet coding.

For multi-channel audio data, the multiple channels of frequency coefficient data produced by the frequency transformer (110) often correlate. To exploit this correlation, the multi-channel transformer (120) can convert the multiple original, independently coded channels into jointly coded channels. For example, if the input is stereo mode, the multi-channel transformer (120) can convert the left and right channels into sum and difference channels:

$$X_{Sum}[k] = \frac{X_{Left}[k] + X_{Right}[k]}{2} \quad (1)$$

$$X_{Diff}[k] = \frac{X_{Left}[k] - X_{Right}[k]}{2} \quad (2)$$

Or, the multi-channel transformer (120) can pass the left and right channels through as independently coded channels. More generally, for a number of input channels greater than one, the multi-channel transformer (120) passes original, independently coded channels through unchanged or converts the original channels into jointly coded channels. The decision to use independently or jointly coded channels can be predetermined, or the decision can be made adaptively on a block by block or other basis during encoding. The multi-channel transformer (120) produces side information to the MUX (180) indicating the channel transform mode used.

The perception modeler (130) models properties of the human auditory system to improve the quality of the reconstructed audio signal for a given bit-rate. The perception modeler (130) computes the excitation pattern of a variable-size block of frequency coefficients. First, the perception modeler (130) normalizes the size and amplitude scale of the block. This enables subsequent temporal smearing and establishes a consistent scale for quality measures. Optionally, the perception modeler (130) attenuates the coefficients at certain frequencies to model the outer/middle ear transfer function. The perception modeler (130) computes the energy of the coefficients in the block and aggregates the energies by 25 critical bands. Alternatively, the perception modeler (130) uses another number of critical bands (e.g., 55 or 109). The frequency ranges for the critical bands are implementation-dependent, and numerous options are well known. For example, see ITU-R BS 1387 or a reference mentioned therein. The perception modeler (130) processes the band energies to account for simultaneous and temporal masking. In alternative embodiments, the perception modeler (130) processes the audio data according to a different auditory model, such as one described or mentioned in ITU-R BS 1387.

The weighter (140) generates weighting factors (alternatively called a quantization matrix) based upon the excitation pattern received from the perception modeler (130) and applies the weighting factors to the data received from the multi-channel transformer (120). The weighting factors include a weight for each of multiple quantization bands in the audio data. The quantization bands can be the same or different in number or position from the critical bands used elsewhere in the encoder (100). The weighting factors indicate proportions at which noise is spread across the quantization bands, with the goal of minimizing the audibility of the noise by putting more noise in bands where it is less audible, and vice versa. The weighting factors can vary in amplitudes and number of quantization bands from block to block. In one implementation, the number of quantization bands varies according to block size; smaller blocks have fewer quantization bands than larger blocks. For example, blocks with 128 coefficients have 13 quantization bands, blocks with 256 coefficients have 15 quantization bands, up to 25 quantization bands for blocks with 2048 coefficients. These block-band proportions are only exemplary. The weighter (140) generates a set of weighting factors for each channel of multi-channel audio data in independently or jointly coded channels, or generates a single set of weighting factors for jointly coded channels. In alternative embodiments, the weighter (140) generates the weighting factors from information other than or in addition to excitation patterns.

The weighter (140) outputs weighted blocks of coefficient data to the quantizer (150) and outputs side information such as the set of weighting factors to the MUX (180). The weighter (140) can also output the weighting factors to the rate/quality controller (140) or other modules in the encoder (100). The set of weighting factors can be compressed for more efficient representation. If the weighting factors are lossy compressed, the reconstructed weighting factors are typically used to weight the blocks of coefficient data. If audio information in a band of a block is completely eliminated for some reason (e.g., noise substitution or band truncation), the encoder (100) may be able to further improve the compression of the quantization matrix for the block.

The quantizer (150) quantizes the output of the weighter (140), producing quantized coefficient data to the entropy encoder (160) and side information including quantization step size to the MUX (180). Quantization introduces irreversible loss of information, but also allows the encoder (100) to regulate the bit-rate of the output bitstream (195) in conjunction with the rate/quality controller (170). In FIG. 1, the quantizer (150) is an adaptive, uniform scalar quantizer. The quantizer (150) applies the same quantization step size to each frequency coefficient, but the quantization step size itself can change from one iteration to the next to affect the bit-rate of the entropy encoder (160) output. In alternative embodiments, the quantizer is a non-uniform quantizer, a vector quantizer, and/or a non-adaptive quantizer.

The entropy encoder (160) losslessly compresses quantized coefficient data received from the quantizer (150). For example, the entropy encoder (160) uses multi-level run length coding, variable-to-variable length coding, run length coding, Huffman coding, dictionary coding, arithmetic coding, LZ coding, a combination of the above, or some other entropy encoding technique.

The rate/quality controller (170) works with the quantizer (150) to regulate the bit-rate and quality of the output of the encoder (100). The rate/quality controller (170) receives information from other modules of the encoder (100). In one implementation, the rate/quality controller (170) receives estimates of future complexity from the frequency transformer (110), sampling rate, block size information, the excitation pattern of original audio data from the perception modeler (130), weighting factors from the weighter (140), a block of quantized audio information in some form (e.g., quantized, reconstructed, or encoded), and buffer status information from the MUX (180). The rate/quality controller (170) can include an inverse quantizer, an inverse weighter, an inverse multi-channel transformer, and, potentially, an entropy decoder and other modules, to reconstruct the audio data from a quantized form.

The rate/quality controller (170) processes the information to determine a desired quantization step size given current conditions and outputs the quantization step size to the quantizer (150). The rate/quality controller (170) then measures the quality of a block of reconstructed audio data as quantized with the quantization step size, as described below. Using the measured quality as well as bit-rate information, the rate/quality controller (170) adjusts the quantization step size with the goal of satisfying bit-rate and quality constraints, both instantaneous and long-term. In alternative embodiments, the rate/quality controller (170) works with different or additional information, or applies different techniques to regulate quality and bit-rate.

In conjunction with the rate/quality controller (170), the encoder (100) can apply noise substitution, band truncation, and/or multi-channel rematrixing to a block of audio data. At low and mid-bit-rates, the audio encoder (100) can use noise substitution to convey information in certain bands. In band truncation, if the measured quality for a block indicates poor quality, the encoder (100) can completely eliminate the coefficients in certain (usually higher frequency) bands to improve the overall quality in the remaining bands. In multi-channel rematrixing, for low bit-rate, multi-channel audio data in jointly coded channels, the encoder (100) can suppress information in certain channels (e.g., the difference channel) to improve the quality of the remaining channel(s) (e.g., the sum channel).

The MUX (180) multiplexes the side information received from the other modules of the audio encoder (100) along with the entropy encoded data received from the entropy encoder (160). The MUX (180) outputs the information in WMA or in another format that an audio decoder recognizes.

The MUX (180) includes a virtual buffer that stores the bitstream (195) to be output by the encoder (100). The virtual buffer stores a pre-determined duration of audio information (e.g., 5 seconds for streaming audio) in order to smooth over short-term fluctuations in bit-rate due to complexity changes in the audio. The virtual buffer then outputs data at a relatively constant bit-rate. The current fullness of the buffer, the rate of change of fullness of the buffer, and other characteristics of the buffer can be used by the rate/quality controller (170) to regulate quality and bit-rate.

Exemplary Generalized Audio Decoder

With reference to FIG. 2, the generalized audio decoder (200) includes a bitstream demultiplexer ["DEMUX"] (210), an entropy decoder (220), an inverse quantizer (230), a noise generator (240), an inverse weighter (250), an inverse multi-channel transformer (260), and an inverse frequency transformer (270). The decoder (200) is simpler than the encoder (100) is because the decoder (200) does not include modules for rate/quality control.

The decoder (200) receives a bitstream (205) of compressed audio data in WMA or another format. The bitstream (205) includes entropy encoded data as well as side information from which the decoder (200) reconstructs audio samples (295). For audio data with multiple channels, the decoder (200) processes each channel independently, and can work with jointly coded channels before the inverse multi-channel transformer (260).

The DEMUX (210) parses information in the bitstream (205) and sends information to the modules of the decoder (200). The DEMUX (210) includes one or more buffers to compensate for short-term variations in bit-rate due to fluctuations in complexity of the audio, network jitter, and/or other factors.

The entropy decoder (220) losslessly decompresses entropy codes received from the DEMUX (210), producing quantized frequency coefficient data. The entropy decoder (220) typically applies the inverse of the entropy encoding technique used in the encoder.

The inverse quantizer (230) receives a quantization step size from the DEMUX (210) and receives quantized frequency coefficient data from the entropy decoder (220). The inverse quantizer (230) applies the quantization step size to the quantized frequency coefficient data to partially reconstruct the frequency coefficient data. In alternative embodiments, the inverse quantizer applies the inverse of some other quantization technique used in the encoder.

The noise generator (240) receives from the DEMUX (210) indication of which bands in a block of data are noise substituted as well as any parameters for the form of the noise. The noise generator (240) generates the patterns for the indicated bands, and passes the information to the inverse weighter (250).

The inverse weighter (250) receives the weighting factors from the DEMUX (210), patterns for any noise-substituted bands from the noise generator (240), and the partially reconstructed frequency coefficient data from the inverse quantizer (230). As necessary, the inverse weighter (250) decompresses the weighting factors. The inverse weighter (250) applies the weighting factors to the partially reconstructed frequency coefficient data for bands that have not been noise substituted. The inverse weighter (250) then adds in the noise patterns received from the noise generator (240).

The inverse multi-channel transformer (260) receives the reconstructed frequency coefficient data from the inverse weighter (250) and channel transform mode information from the DEMUX (210). If multi-channel data is in independently coded channels, the inverse multi-channel transformer (260) passes the channels through. If multi-channel data is in jointly coded channels, the inverse multi-channel transformer (260) converts the data into independently coded channels. If desired, the decoder (200) can measure the quality of the reconstructed frequency coefficient data at this point.

The inverse frequency transformer (270) receives the frequency coefficient data output by the multi-channel transformer (260) as well as side information such as block sizes from the DEMUX (210). The inverse frequency transformer (270) applies the inverse of the frequency transform used in the encoder and outputs blocks of reconstructed audio samples (295).

Figure 3:
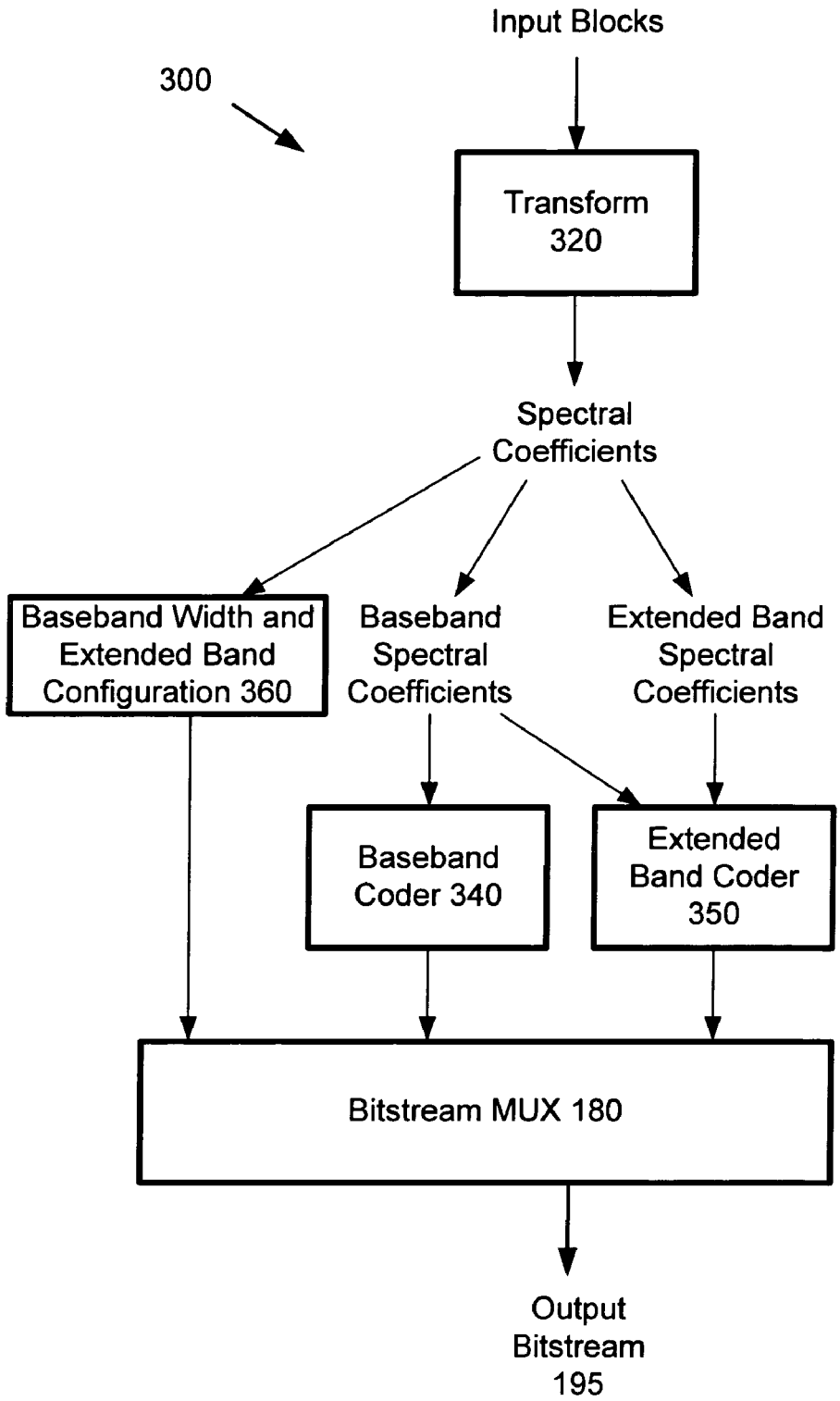
FIG. 3 is a block diagram of a baseband coder and extended band coder implementing the efficient audio coding using modified codewords and or variable frequency segmentation that can be incorporated into the general audio encoder of FIG. 1.

Exemplary Encoding/Decoding with Modified Codewords and Wide-Sense Perceptual Similarity FIG. 3 illustrates one implementation of an audio encoder (300) using encoding with adaptive sub-band configuration and/or modified codewords such as, with wide-sense perceptual similarity, that can be incorporated into the overall audio encoding/decoding process of the generalized audio encoder (100) and decoder (200) of FIGS. 1 and 2. In this implementation, the audio encoder (300) performs a spectral decomposition in transform (320), using either a sub-band transform or an overlapped orthogonal transform such as MDCT or MLT, to produce a set of spectral coefficients for each input block of the audio signal. As is conventionally known, the audio encoder codes these spectral coefficients for sending in the output bitstream to the decoder. The coding of the values of these spectral coefficients constitutes most of the bit-rate used in an audio codec. At low bit-rates, the audio encoder (300) selects to code fewer of the spectral coefficients using a baseband coder (340) (i.e., a number of coefficients that can be encoded within a percentage of the bandwidth of the spectral coefficients output from the frequency transformer (110)), such as a lower or base-band portion of the spectrum. The baseband coder (340) encodes these baseband spectral coefficients using a conventionally known coding syntax, as described for the generalized audio encoder above. This would generally result in the reconstructed audio sounding muffled or low-pass filtered.

The audio encoder (300) avoids the muffled/low-pass effect by also coding the omitted spectral coefficients using adaptive sub-band configuration and/or modified codewords with wide-sense perceptual similarity. The spectral coefficients (referred to here as the "extended band spectral coefficients") that were omitted from coding with the baseband coder (340) are coded by extended band coder (350) as shaped noise, or shaped versions of other frequency components, or two or more combinations of the two. More specifically, the extended band spectral coefficients are divided into a number of sub-bands of various and potentially different sizes (e.g., of typically 16, 32, 64, 128, 256, . . . , etc. spectral coefficients), which are coded as shaped noise or shaped versions of other frequency components. This adds a perceptually pleasing version of the missing spectral coefficient to give a full richer sound. Even though the actual spectrum may deviate from the synthetic version resulting from this encoding, this extended band coding provides a similar perceptual effect as in the original.

In some implementations, the width of the base-band (i.e., number of baseband spectral coefficients coded using the baseband coder 340) as well as the size or number of extended bands can be varied from a default or initial configuration. In such case, the width of the baseband and/or number (or size) of extended bands coded using the extended band coder (350) can be coded (360) into the output stream (195).

If desirable, the partitioning of the bitstream between the baseband spectral coefficients and extended band coefficients in the audio encoder (300) is done to ensure backward compatibility with existing decoders based on the coding syntax of the baseband coder, such that such existing decoder can decode the baseband coded portion while ignoring the extended portion. The result is that newer decoders have the capability to render the full spectrum covered by the extended band coded bitstream, whereas the older decoders may render the portion which the encoder chose to encode with the existing syntax. The frequency boundary (e.g., the boundary between baseband and extended portion) can be flexible and time-varying. It can either be decided by the encoder based on signal characteristics and explicitly sent to the decoder, or it can be a function of the decoded spectrum, so it does not need to be sent. Since the existing decoders can only decode the portion that is coded using the existing (baseband) codec, this means that the lower portion of the spectrum (e.g., baseband) is coded with the existing codec and the higher portion is coded using the extended band coding with modified codewords using wide-sense perceptual similarity.

In other implementations where such backward compatibility is not needed, the encoder then has the freedom to choose between the conventional baseband coding and the extended band (with modified codewords and wide-sense perceptual similarity approach) solely based on signal characteristics and the cost of encoding without considering the frequency boundary location. For example, although it is highly unlikely in natural signals, it may be better to encode the higher frequency with the traditional codec and the lower portion using the extended codec.

Exemplary Method of Encoding

Figure 4:
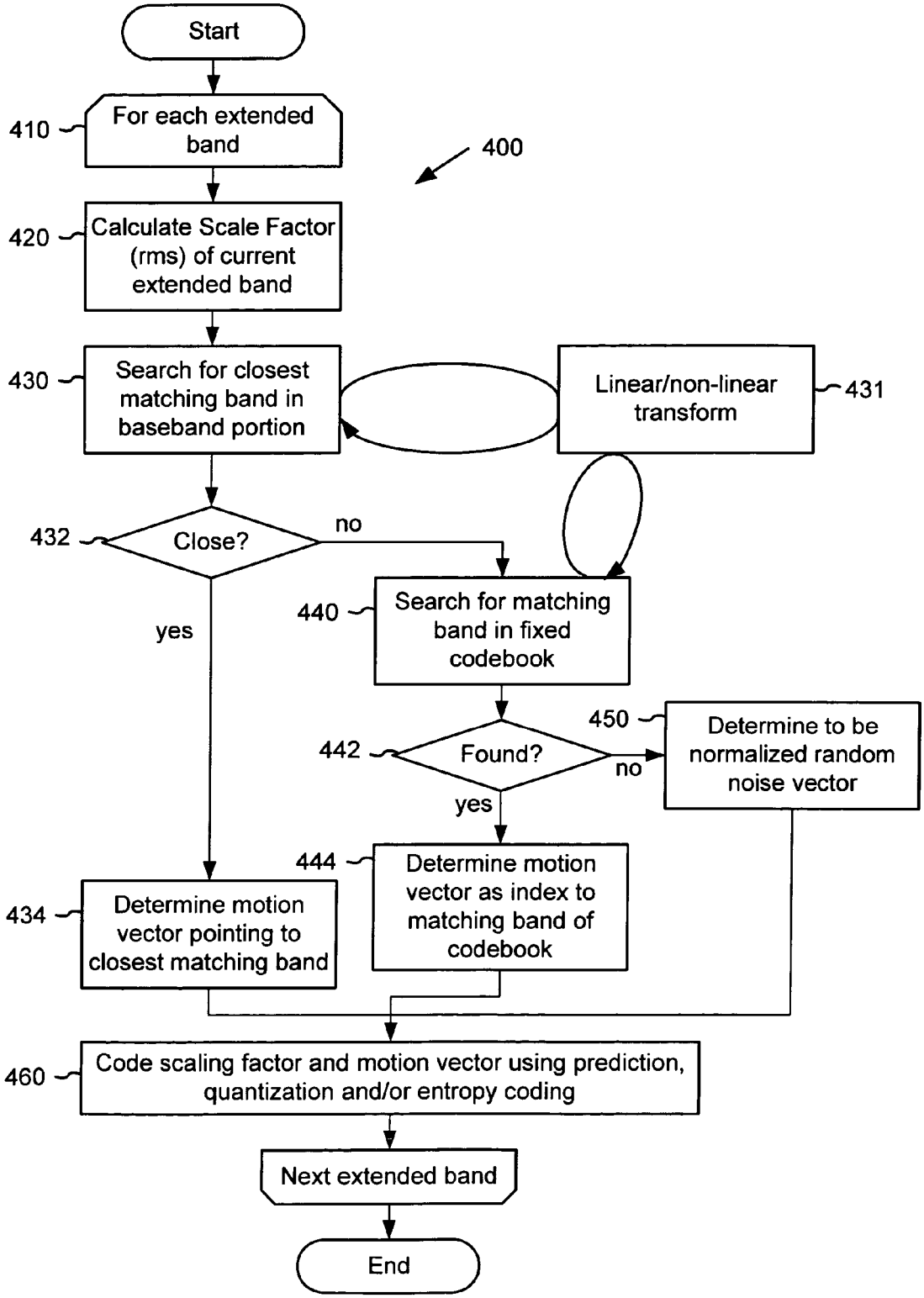
FIG. 4 is a flow diagram of encoding bands with the efficient audio coding using the extended band coder of FIG. 3.

FIG. 4 is a flow chart depicting an audio encoding process (400) performed by the extended band coder (350) of FIG. 3 to encode the extended band spectral coefficients. In this audio encoding process (400), the extended band coder (350) divides the extended band spectral coefficients into a number of sub-bands. In a typical implementation, these sub-bands generally would consist of 64 or 128 spectral coefficients each. Alternatively, other size sub-bands (e.g., 16, 32 or other numbers of spectral coefficients) can be used. If an extended band encoder provides the possibility of modifying the size of sub-bands, an extended band configuration process (360) modifies the sub-bands and encodes the extended band configuration. The sub-bands can be disjoint or can be overlapping (using windowing). With overlapping sub-bands, more bands are coded. For example, if 128 spectral coefficients have to be coded using the extended band coder with sub-bands of size 64, the method will use two disjoint bands to code the coefficients, coding coefficients 0 to 63 as one sub-band and coefficients 64 to 127 as the other. Alternatively, three overlapping bands with 50% overlap can be used, coding 0 to 63 as one band, 32 to 95 as another band, and 64 to 127 as the third band. Various other dynamic methods for frequency segmentation of sub-bands will be discussed later in this specification.

For each of these fixed or dynamically optimized sub-bands, the extended band coder (350) encodes the band using two parameters. One parameter ("scale parameter") is a scale factor which represents the total energy in the band. The other parameter ("shape parameter," generally in the form of a motion vector) is used to represent the shape of the spectrum within the band. Optionally, as will be discussed, the shape parameter will require one or more shape transform bits indicating an exponent, a vector direction (e.g., forward/reverse), and/or a coefficient sign transformation.

As illustrated in the flow chart of FIG. 4, the extended band coder (350) performs the process (400) for each sub-band of the extended band. First (at 420), the extended band coder (350) calculates the scale factor. In one implementation, the scale factor is simply the rms (root-mean-square) value of the coefficients within the current sub-band. This is found by taking the square root of the average squared value of all coefficients. The average squared value is found by taking the sum of the squared value of all the coefficients in the sub-band, and dividing by the number of coefficients.

The extended band coder (350) then determines the shape parameter. The shape parameter is usually a motion vector that indicates to simply copy over a normalized version of the spectrum from a portion of the spectrum that has already been coded (i.e., a portion of the baseband spectral coefficients coded with the baseband coder). In certain cases, the shape parameter might instead specify a normalized random noise vector or simply a vector for a spectral shape from a fixed codebook. Copying the shape from another portion of the spectrum is useful in audio since typically in many tonal signals, there are harmonic components which repeat throughout the spectrum. The use of noise or some other fixed codebook allows for a low bit-rate coding of those components which are not well represented in the baseband-coded portion of the spectrum. Accordingly, the process (400) provides a method of coding that is essentially a gain-shape vector quantization coding of these bands, where the vector is the frequency band of spectral coefficients, and the codebook is taken from the previously coded spectrum and can include other fixed vectors or random noise vectors, as well. That is each sub-band coded by the extended band coder is represented as a*X, where 'a' is a scale parameter and 'X' is a vector represented by the shape parameter, and can be a normalized version of (any) previously coded spectral coefficients, a vector from a fixed codebook, or a random noise vector. Also, if this copied portion of the spectrum is added to a traditional coding of that same portion, then this addition is a residual coding. This could be useful if a traditional coding of the signal gives a base representation (for example, coding of the spectral floor) that is easy to code with a few bits, and the remainder is coded with the new algorithm.

More specifically, at action (430), the extended band coder (350) searches the baseband (or other previously coded) spectral coefficients for a vector in the baseband of spectral coefficients having a similar shape as the current sub-band. As stated previously, a "codeword from the baseband" also includes sources outside the present baseband. The extended band coder determines which portion of the baseband (or other previous band) is most similar to the current sub-band using a least-means-square comparison to a normalized version of each portion of the baseband. Optionally, a linear or non-linear transform (431) is applied to one or more portions of the spectrum in the baseband (or other previous band) in order to create a larger universe of shapes for matching. Again, the baseband includes the library and other previous bands when discussing sources for codewords. Optionally, the extended band encoder performs one or more linear or non-linear transforms on the baseband and/or fixed codebooks in order to provide a larger library of available shapes for matching. For example, consider a case in which there are 256 spectral coefficients produced by the transform (320) from an input block, the extended band sub-bands (in this example) are each 16 spectral coefficients in width, and the baseband coder encodes the first 128 spectral coefficients (numbered 0 through 127) as the baseband. Then, the search performs a least-means-square comparison of the normalized 16 spectral coefficients in each extended band to a normalized version of each 16 spectral coefficient portion of the baseband (or any previously coded band) beginning at coefficient positions 0 through 111 (i.e., a total of 112 possible different spectral shapes coded in the baseband in this case). The baseband portion having the lowest least-mean-square value is considered closest (most similar) in shape to the current extended band. Optionally, the search performs the least-means-square comparison on the linear or non-linear transformations (431) of the baseband (or other bands). At action (432), the extended band coder checks whether this most similar band out of the baseband spectral coefficients is sufficiently close in shape to the current extended band (e.g., the least-mean-square value is lower than a pre-selected threshold). If so, then the extended band coder determines a motion vector pointing to this closest matching band of baseband spectral coefficients at action (434) and optionally, information about a linear or non-linear transformation on the best match motion vector. The motion vector can be the starting coefficient position in the baseband (e.g., 0 through 111 in the example). Other methods (such as checking tonality vs. non-tonality) can also be used to see if the most similar band out of the baseband (or other bands) spectral coefficients is sufficiently close in shape to the current extended band.

If no sufficiently similar portion of the baseband is found, the extended band coder then looks to a fixed codebook (440) of spectral shapes to represent the current sub-band. The extended band coder searches this fixed codebook (440) for a similar spectral shape to that of the current sub-band. Optionally, the search performs the least-means-square comparisons on the linear or non-linear transformations (431) of the fixed codebook. If found, the extended band coder uses its index in the code book as the shape parameter at action (444) and optionally, information about a linear or non-linear transform on the best match index in the codebook. Otherwise, at action (450), the extended band coder may also determine to represent the shape of the current sub-band as a normalized random noise vector.

In alternative implementations, the extended band encoder can decide whether the spectral coefficients can be represented using noise even before searching for the best spectral shape in the baseband. This way even if a close enough spectral shape is found in the baseband, the extended band coder will still code that portion using random noise. This can result in fewer bits when compared to sending the motion vector corresponding to a position in the baseband.

At action (460), extended band coder encodes the scale and shape parameters (i.e., scaling factor and motion vector in this implementation, and optionally, linear or non-linear transform information) using predictive coding, quantization and/or entropy coding. In one implementation, for example, the scale parameter is predictive coded based on the immediately preceding extended sub-band. (The scaling factors of the sub-bands of the extended band typically are similar in value, so that successive sub-bands typically have scaling factors close in value.) In other words, the full value of the scaling factor for the first sub-band of the extended band is encoded. Subsequent sub-bands are coded as their difference of their actual value from their predicted value (i.e., the predicted value being the preceding sub-band's scaling factor). For multi-channel audio, the first sub-band of the extended band in each channel is encoded as its full value, and subsequent sub-bands' scaling factors are predicted from that of the preceding sub-band in the channel. In alternative implementations, the scale parameter also can be predicted across channels, from more than one other sub-band, from the baseband spectrum, or from previous audio input blocks, among other variations.

The extended band coder further quantizes the scale parameter using uniform or non-uniform quantization. In one implementation, a non-uniform quantization of the scale parameter is used, in which a log of the scaling factor is quantized uniformly to 128 bins. The resulting quantized value is then entropy coded using Huffman coding.

For the shape parameter, the extended band coder also uses predictive coding (which may be predicted from the preceding sub-band as for the scale parameter), quantization to 64 bins, and entropy coding (e.g., with Huffman coding).

In some implementations, the extended band sub-bands can be variable in size. In such cases, the extended band coder also encodes the configuration of the extended band.

More particularly, in one example implementation, the extended band coder encodes the scale and shape parameters as shown by the pseudo-code listing in Table 1. More than one scale or shape parameter may be sent for the multiple codeword case.

TABLE 1

```
for each tile in audio stream
{
    for each channel in tile that may need to be coded (e.g.
subwoofer may not need to be coded)
    {
        1 bit to indicate if channel is coded or not.
        8 bits to specify quantized version of starting position of
extended band.
        'n_config' bits to specify coding of band configuration.
        for each sub-band to be coded using extended band coder
        {
            'n_scale' bits for variable length code to specify scale
parameter (energy in band).
            'n_shape' bits for variable length code to specify shape
parameter.
            'n_transformation' bits for non/linear transform
parameters.
        }
    }
}
```

In the above code listing, the coding to specify the band configuration (i.e., number of bands, and their sizes) depends on the number of spectral coefficients to be coded using the extended band coder. The number of coefficients coded using the extended band coder can be found using the starting position of the extended band and the total number of spectral coefficients (number of spectral coefficients coded using extended band coder=total number of spectral coefficients−starting position). In one example, the band configuration is then coded as an index into listing of all possible configurations allowed. This index is coded using a fixed length code with n_config=log 2(number of configurations) bits. Configurations allowed is a function of number of spectral coefficients to be coded using this method. For example, if 128 coefficients are to be coded, the default configuration is 2 bands of size 64. Other configurations might be possible, for example, Table 2 shows a listing of band configurations for 128 spectral coefficients.

TABLE 2

| | | | | |
|---|---|---|---|---|
| 0: | 128 | | | |
| 1: | 64 | | 64 | |
| 2: | 64 | | 32 | 32 |
| 3: | 32 | 32 | 64 | |
| 4: | 32 | 32 | 32 | 32 |

Thus, in this example, there are 5 possible band configurations. In such a configuration, a default configuration for the coefficients is chosen as having 'n' bands. Then, allowing each band to either split or merge (only one level), there are $5^{(n/2)}$ possible configurations, which requires (n/2)log 2(5) bits to code. In other implementations, variable length coding can be used to code the configuration. No specific method of extended band configuration is required to benefit from codeword modification. Additionally, various other methods for extended band configuration are discussed later that do not require any such codeword modification methods in order to be beneficial.

As discussed above, the scale factor is coded using predictive coding, where the prediction can be taken from previously coded scale factors from previous bands within the same channel, from previous channels within same tile, or from previously decoded tiles. For a given implementation, the choice for the prediction can be made by looking at which previous band (within same extended band, channel or tile (input block)) provided the highest correlations. In one implementation example, the band is predictive coded as follows:

Let the scale factors in a tile be x[i][j], where i=channel index, j=band index.

For i==0 && j==0 (first channel, first band), no prediction.

For i!=0 && j==0 (other channels, first band), prediction is x[0][0] (first channel, first band)

For i!=0 && j!=0 (other channels, other bands), prediction is x[i][j−1] (same channel, previous band).

In the above code table, the "shape parameter" is a motion vector specifying the location of previous codeword of spectral coefficients, or vector from fixed codebook, or noise. The previous spectral coefficients can be from within same channel, or from previous channels, or from previous tiles. The shape parameter is coded using prediction, where the prediction is taken from previous locations for previous bands within same channel, or previous channels within same tile, or from previous tiles. Any linear or non-linear transform can be applied to a shape. The "transformation" parameter indicates such transform information, index to transform information, or etc.

Exemplary Method of Decoding

Figure 5:
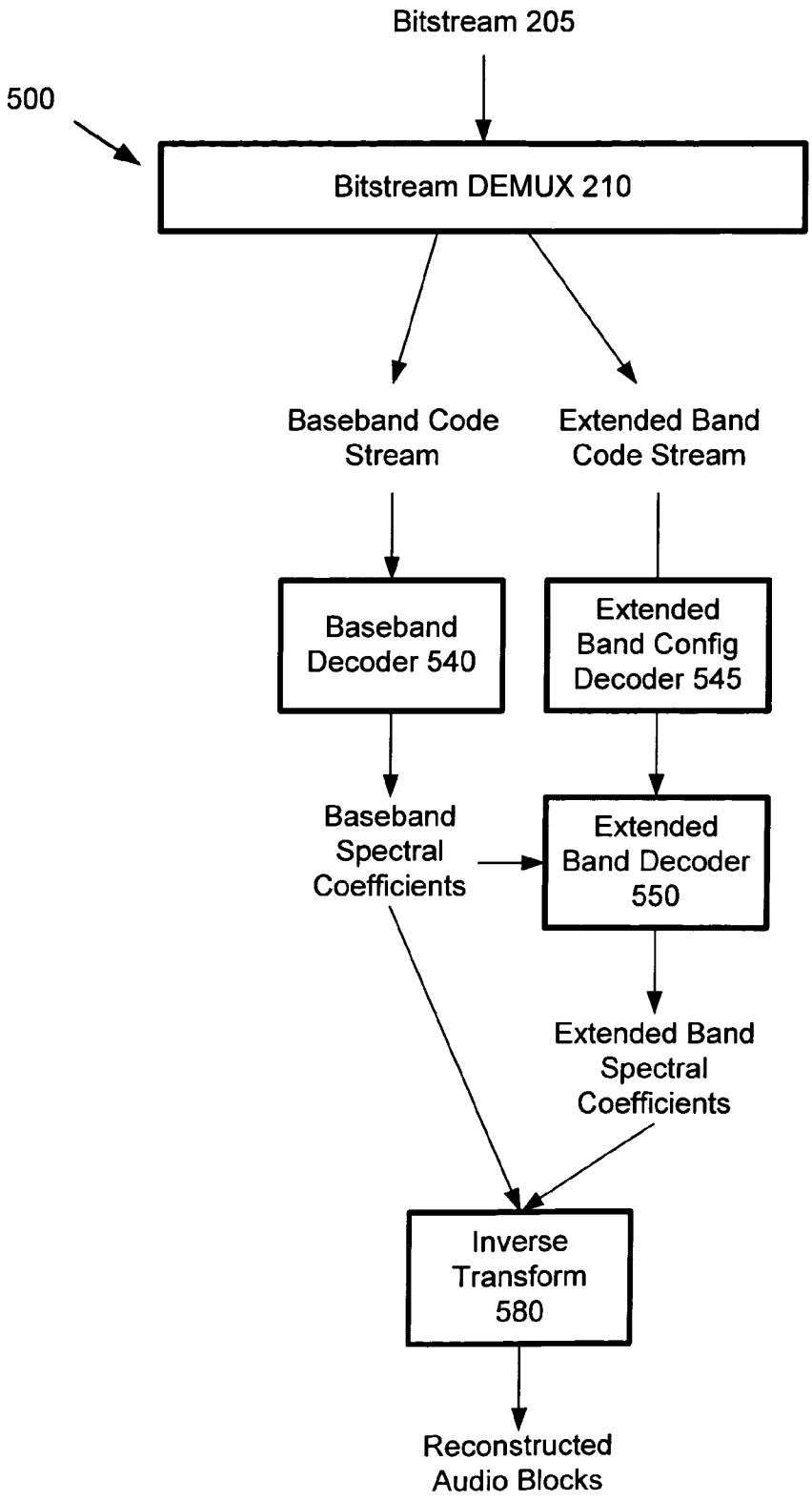
FIG. 5 is a block diagram of a baseband decoder, an extended band configuration decoder, and extended band decoder that can be incorporated into the general audio decoder of FIG. 2.

FIG. 5 shows an audio decoder (500) for the bitstream produced by the audio encoder (300). In this decoder, the encoded bitstream (205) is demultiplexed (e.g., based on the coded baseband width and extended band configuration) by bitstream demultiplexer (210) into the baseband code stream and extended band code stream, which are decoded in baseband decoder (540) and extended band decoder (550). The baseband decoder (540) decodes the baseband spectral coefficients using conventional decoding of the baseband codec. The extended band configuration decoder (545) decodes the optimized band sizes if optimization from a default band configuration is utilized. The extended band decoder (550) decodes the extended band code stream, including by copying over one or more portions of the original or transformed baseband spectral coefficients (or any previous band or codebook) pointed to by the motion vector of the shape parameter (and any optional information about the linear or non-linear transformation of the coefficient pointed to by the motion vector) and scaling by the scaling factor of the scale parameter. The baseband and extended band spectral coefficients are combined into a single spectrum which is converted by inverse transform 580 to reconstruct the audio signal.

Figure 6:
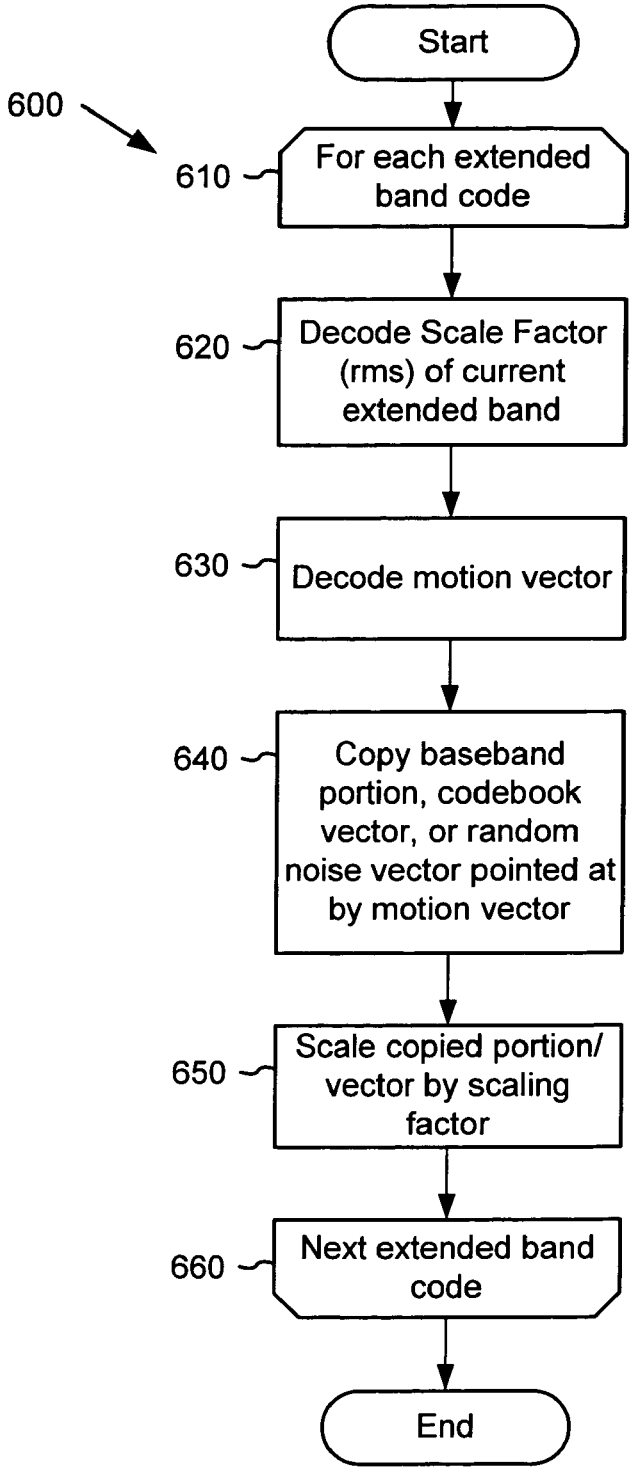
FIG. 6 is a flow diagram of decoding bands with the efficient audio coding using the extended band decoder of FIG. 5.

FIG. 6 shows a decoding process (600) used in the extended band decoder (550) of FIG. 5. For each coded sub-band of the extended band in the extended band code stream (action (610)), the extended band decoder decodes the scale factor (action (620)) and motion vector along with any transformation information (action (630)). The extended band decoder then copies (action (640)) the baseband sub-band, fixed codebook vector, or random noise vector identified by the motion vector (shape parameter and performs any identified transformation). The extended band decoder scales the copied spectral band or vector by the scaling factor to produce the spectral coefficients for the current sub-band of the extended band.

Exemplary Spectral Coefficients

Figure 7:
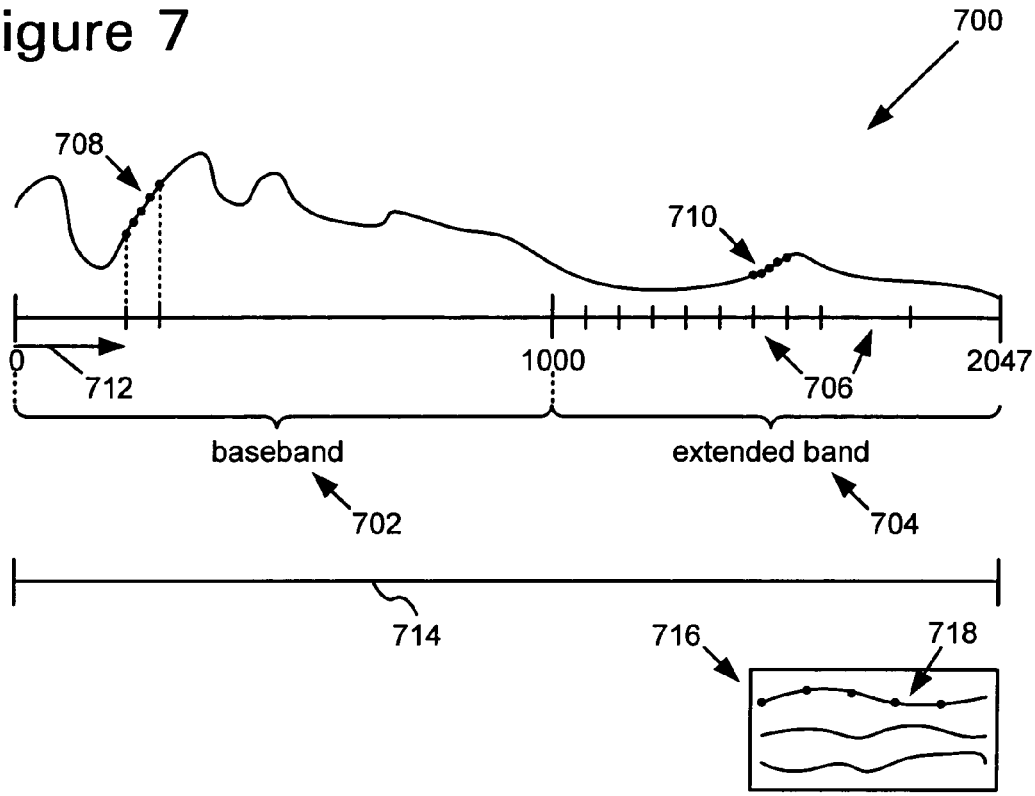
FIG. 7 is a graph representing a set of spectral coefficients.

FIG. 7 is a graph representing a set of spectral coefficients. For example, the coefficients (700) are an output of a transform or an overlapped orthogonal transform such as MDCT or MCT, to produce a set of spectral coefficients for each input block of the audio signal.

As shown in FIG. 7, a portion of the output of the transform called the baseband (702) is encoded by the baseband coder. Then the extended band (704) is divided into sub-bands of homogeneous or varied sizes (706). Shapes in the baseband (708) (e.g., shapes as represented by a series of coefficients) are compared to shapes in the extended band (710), and an offset (712) representing a similar shape in the baseband is used to encode a shape (e.g., sub-band) in the extended band so that fewer bits need to be encoded and sent to the decoder.

A baseband (702) size may vary, and a resulting extended band (704) may vary based on the baseband. The extended band may be divided into various and multiple size sub-band sizes (706).

In this example, a baseband segment (from this or any previous band) is used to identify a codeword (708) to simulate a sub-band in the extended band (710). The codeword (708) can be linearly transformed or non-linearly transformed in order to create other shapes (e.g., other series of coefficients) that might more closely provide a model for the vector (710) being coded.

Thus, plural segments in the baseband are used as potential models (e.g., a codebook, library, or dictionary of codewords) to code data in the extended band. Instead of sending the actual coefficients (710) in a sub-band in the extended band an identifier such as a motion vector offset (712), is sent to the encoder to represent the data for the extended band. However, sometimes there are no close matches in the baseband for data being modeled in a sub-band. This may be because of low bitrate constraints that allow a limited size baseband. As stated, the baseband size (702) as relative to the extended band may vary based on computing resources such as time, output device, or bandwidth.

In another example, another codebook (716) is provided or available to the encoder/decoder, and a best match identifier is provided as an index to a closest match codeword (718) in the codebook. Additionally, in cases where random noise is desirable as a codeword, a portion of the bitstream (such as bits from the baseband) can be used to similarly seed a random number generator at both the encoder and decoder.

These various methods can be used to create a library or dictionary of codewords to provide a larger universe of codewords for matching a shape, for coding a sub-band (710) or other vector, so that the coefficients themselves can be modeled via a motion vector (712) instead of quantized individually.

Exemplary Transformations of Codewords

Figure 8:
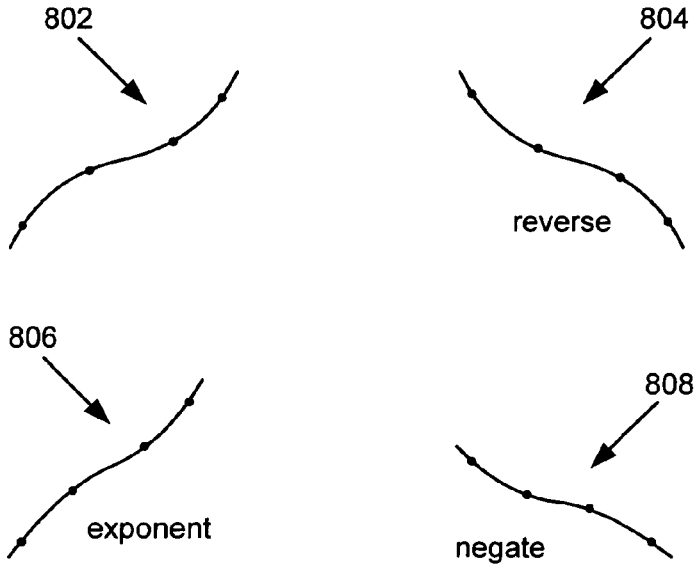
FIG. 8 is a graph of a codeword and various linear and non-linear transformations of the codeword.

FIG. 8 is a graph of a codeword and various linear and non-linear transformations of the codeword. For example, a codeword (802) is from a baseband, a fixed codebook, and/or a randomly generated codeword. Various linear or non-linear transformations are performed on one or more codewords in a library to obtain a greater or more diverse set of shapes for identifying a best shape for matching a vector being coded. In one example, a codeword is reversed (804) in coefficient order to obtain another codeword for shape matching. A reverse of a codeword containing the coefficient values <1, 1.5, 2.2, 3.2> becomes <3.2, 2.2, 1.5, 1>. In another example, the dynamic range or variance of a codeword is reduced (806) using exponentiation with an exponent less than one on each coefficient. Similarly, a codeword's variance is exaggerated (e.g., increased variance) using an exponent greater than one, not shown. For example, a codeword containing the coefficients <1, 1, 2, 1, 4, 2, 1> is raised to the power of 2 to create the codeword <1, 1, 4, 1, 16, 4, 1>. In another example, the coefficients of a codeword <−1, 1, 2, 3> (802) are negated <1, −1, −2, −3> (808). Of course, many other linear and non-linear transformations (e.g., 806) can be performed on one or more codewords in order to provide a larger or more diverse universe or library for matching sub-bands, or other vectors. Additionally, one or more transforms may also be applied in combination to the codewords in order to provide greater diversity of available shapes.

In one example, an encoder first determines a codeword in the baseband that is a closest match to a sub-band being encoded. For example, a least-means-square comparison of coefficients in the baseband can be used to determine a best match. For example, after comparing (708) to (710), the comparison moves one coefficient down the spectrum, one coefficient at a time, to obtain another codeword to compare to (710). Then when a closest match is found, in one example, the shape of the best match codeword is varied by non-linear transform to see if the match can be improved. For example, using an exponent transform on the coefficients of a best match codeword can provide refinement on the match. There are two methods to finding the best code-word match and exponent. In the first method, a best code-word is found typically using the Euclidean distance as the metric (MSE). After the best code-word is found, the best exponent is found. The best exponent is found using one of the following two methods.

One method is to try all the exponents available and see which one gives the minimum Euclidean distance, the other method is to try exponents to see which exponent gives the best histogram or probability mass function (pmf) match. The pmf match can be computed using the second moment about the mean (the variance) for the pmf of the original vector and for each of the exponentiated vectors. The one with the closest match is chosen to be the best exponent.

The second method of finding the best code-word and exponent match is to do an exhaustive search using many combinations of code-words and exponents.

If, for example, $X^{0.5}$ provides a better comparison than $X^{1.0}$, a sub-band is coded using the offset to that codeword in the baseband (712), along with a transformation (linear or non-linear) $x^p$, where one or more bits indicating p=0.5 is sent to and applied at the decoder. In this example, the search proceeded with finding a codeword first, and then varying with a transform, but no such order is required in practice.

In another example, an exhaustive search is performed along the baseband and/or other codebooks to find a best match. For example, a search is performed comprising an exhaustive search along the baseband of all combinations of (exponential transform (p=0.5, 1.0, 2.0), sign transform (+/−), direction (forward/reverse). Similarly, this exhaustive search may be performed along the noise codebook spectrum, or codewords.

In general, a close match can be provided by determining a lowest variance between the sub-band being coded and the codeword and transformation selected to model a sub-band.

An identifier or coded indication of the codeword and/or transform, along with other information such as a scale factor, is coded in the bitstream and provided to the encoder.

Exemplary Multiple Codeword Coding

In one example, two different codewords are utilized for providing a sub-band encoding. For example, given two codewords b and n of length u, are provided $b=<b_0, b_1, \ldots b_u>$ and $n=<n_0, n_1, \ldots n_u>$ to better describe a sub-band being coded. Vector b may be from the baseband, any prior band, a noise codebook, or a library, and vector n may similarly be from any such source. A rule is provided for interleaving coefficients from each two or more codewords b and n, such that the decoder implicitly or explicitly knows which coefficient to take from the codewords b and n. The rule may be provided in the bitstream or may be known by the decoder implicitly.

The rule and two or more vectors are used at the decoder to create the sub-based $s=<n_0, b_1, n_2, n_3, b_4, \ldots n_u>$. For example, a rule is established based on the order of the codewords sent, and a percentage value "a". The encoder delivers information in the order (b, n, a). The decoder translates the information into a requirement to take any coefficient from the first vector b if that coefficient is less than 'a' multiplied by the highest coefficient value M in vector b. Thus, if a coefficient $b_1$ is greater than a*M, then $b_1$ is in vector s, otherwise $n_1$ is in s. Another rule may require that in order for $b_1$ to be in vector s, it has to be part of a group of T adjacent coefficients with a value less than a*M. If a default value for 'a' is set, then 'a' does not need to be sent to the decoder, since it is implicit.

Thus, a decoder can send two or more codeword identifiers, and optionally, a rule to decode which coefficients to take to create the sub-band. The encoder will also send scale factor information for codewords, and optionally if relevant, any other codeword transform information since b and/or n may be linearly or non-linearly transformed.

Using two or more codewords b and n above, an encoder would send an identifier (e.g., a motion vector, codebook index, etc.) of the codewords, a rule (e.g., index to rulebook) or the rule will be implicitly known by both the encoder and decoder, any additional transform information (e.g., $x^p$, p=0.5, assuming b or n also requires additional transform), and information about scale factors (e.g., $s_b$, $s_n$, etc.). Scale factor information may also be a scale factor and a ratio (e.g., $s_b$, $s_b/s_n$, etc.). With one vector scale factor and a ratio, the decoder will have enough information to compute the other scale factor.

Exemplary Enhancement of Baseband

Under certain conditions, such as low bitrate applications, the baseband itself may not be well coded (e.g., several consecutive or intermingled zero coefficients). In one such example, the baseband represents peaks of intensity well, but does not well represent subtle variances at coefficients representing lower intensities between peaks. In such a case, the peaks of a codeword from the baseband itself are selected as a first vector (e.g., b), and the zero coefficients, or very low relative coefficients are replaced with a second vector (e.g., n) that more closely resembles the low energy between peaks. Thus, the two codeword method can be used on the baseband or sub-band of the baseband, to provide baseband enhancement. As before, the rule used for selecting from the first, or second vector, may be explicit and sent to the decoder, or implicit. In some cases the second vector may best be provided via a noise codeword.

Exemplary Transformations

A baseband, previous band or other codebook provides a library of consecutive coefficients, each coefficient potentially serving as the first coefficient in a series of consecutive coefficients that may serve as a codeword. A best match codeword in the library is identified and sent to a decoder, along with a scale factor, and is used by the decoder to create a sub-band in the extended sub-band.

Optionally, one or more codewords in the library are transformed to provide a larger universe of available codewords to find a best match for a shape being coded. In mathematics, a universe of linear and non-linear transformations exists for shapes, vectors, and matrices. For example, a vector can be reversed, negated across an axis, and shape can be otherwise altered with linear and non-linear transformations such as by applying root functions, exponents, etc. A search is performed on the library of codewords, including applying one or more linear or non-linear transforms on the codewords, and a closest match codeword is identified, along with any transform. An identifier of a best match, codeword, a scale factor, and a transform identifier is sent to a decoder. A decoder receives the information and reconstructs a sub-band in the extended band.

Optionally, an encoder selects two or more codewords that together best represents a sub-band being coded and/or enhanced. A rule is used to select or interleave individual coefficient positions in the sub-band being coded. The rule is implicit or explicit. The sub-band being coded may be in the extended band, or may be a sub-band in the baseband being enhanced. The two or more codewords being used may be from a baseband or any other codebook, and one or more of the codewords may be transferred linearly or non-linearly.

Exemplary Envelope Matching

A signal called "an envelope" (e.g., Env(i)) is generated by running a weighted average on the input signal x(i) (e.g., audio, video, etc.) as follows:

$$Env(i) = \sum_{v=-L}^{L} w(j)|x(i+j)|$$

where w(j) is a weighting function (presently a triangle shape) and L is the number of neighborhood coefficients to be considered in the weighted analysis. Previously, and example of an exhaustive search was discussed using an input universe of codewords, exponent transformation (0.5, 1.0, 2.0), coefficient negation (sign +/−) and codeword coefficient direction (forward, reverse). Instead a best 'Q' number of codewords are first selected (combinations of codeword, exponent, sign, and/or direction) are selected using a Euclidean distance between the envelopes of the sub-band being coded, and the codeword. The original unquantized versions of the codewords may be useful to measure the envelope Euclidean distance. From these Q closest candidates determined based on Euclidean distance, a best match is selected. Optionally, after envelopes are considered, a method (such as previously described codeword comparison methods) may return to examine which of the Q candidates best fit.

Exemplary Codeword Modification

Given a codebook consisting of code vectors, a modification of the code-vectors in the codebook is proposed such that they better represent the vector being coded. The codebook/codeword modification can consist of any combination of one or more of the following transformations.

Linear transform applied to a code-vector.

Non-linear transform applied to a code-vector.

Combining more than one code-vector to obtain a new code-vector (the vectors being combined can come from the same codebook, different codebooks, or be random).

Combining a code-vector with a base coding.

The information relating to which transformation, if any, is used and which code-vectors are used in the transformation is either sent to the decoder in the bitstream or computed at the decoder using knowledge that it already has (data that it has already decoded). A vector is typically a certain band of spectral coefficients which are to be coded.

Three examples in particular are given for codeword modifications:

(1) exponentiation applied to each component of the vector (non-linear transform), (2) combining of two (or more) vectors to form a new-vector, where each of the two vectors is used to represent portions of the vector which have different characteristics, and (3) combining a code-vector with a base coding. In the following discussion, v will be used to represent the vector to be coded, x will be the code vector or codeword being used to code v, and y will be the modified code vector. Vector v will be coded using an approximation v'=Sx, where S is a scale factor. The scale factor used is a quantized version of the ratio of power between v and x, $$S = \frac{Q(\|v\|)}{\|x\|},$$

where Q(.) is quantization, and ||.|| represents the norm, which is the power in the vector. A quantized version of the power in the original vector is sent. The decoder computes the scale factor to use by dividing by power in the code-vector.

Exemplary Non-Linear Transformation

A first example consists of applying an exponent to each component in the code-vector. Table 3 provides a non-linear transformation of a series of coefficients in a codeword.

TABLE 3

| | | | | | | | | |
|---|---|---|---|---|---|---|---|---|
| Codeword | 1 | 2 | 3 | 2 | 1 | 1 | 2 | 3 |
| Transformation | 1 | 4 | 9 | 4 | 1 | 1 | 4 | 9 |

In this example, each coefficient in a codeword (code-vector) is raised to the power of exponent two ($x^2$). In such an example, if the shape of the transformed codeword is a best fit for a vector to be coded, then the encoder will provide an identification of the codeword and the transformation leading to a best match.

The exponent can be sent to the decoder using a fixed number of bits, or can be sent from a codebook of exponents, or can be implicitly calculated at the decoder using previously seen data. For example, for an L dimensional vector, let the components of the 'i'th code-vector in a codebook be $x_i[0]$, $x_i[1]$, . . . , $x_i[L-1]$. Then, the exponentiation applies an exponent 'p' to modify the vector to get a new vector $y_i$, $$y_i[j]=(x_i[j])^p, \text{ for } j=0,1,\ldots,L-1,$$

where 'j' is the component index. This non-linear transformation allows a code vector which has peaks to be used to code a vector which does not by using a value of p which is less than 1. Similarly, it allows a non-peaky code-vector to be used to represent one with peaks by using p>1.

Figure 9:
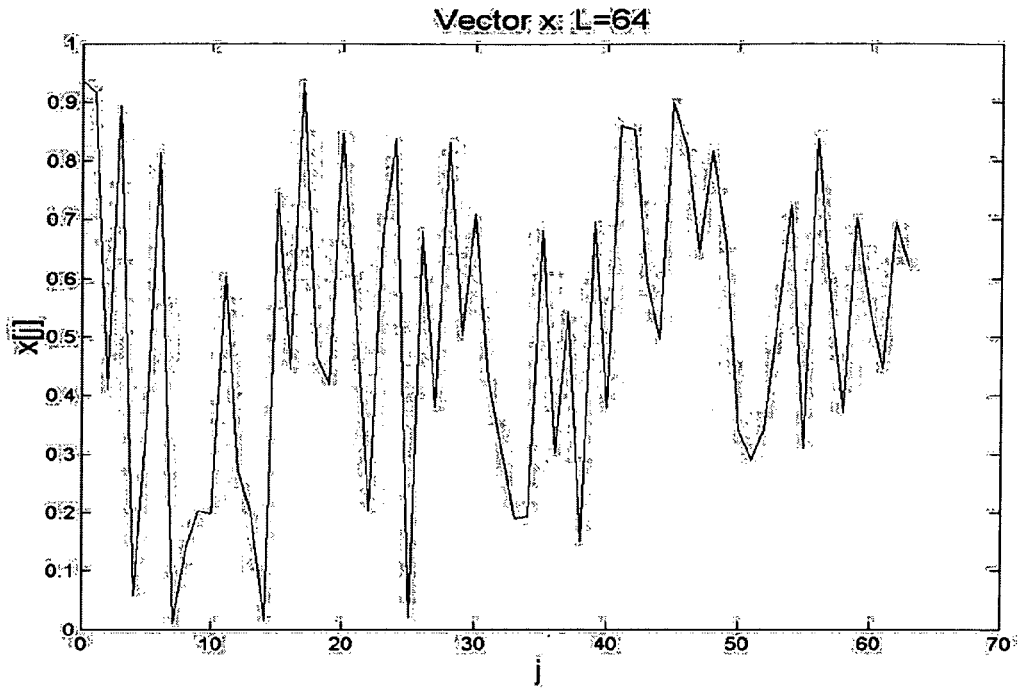
FIG. 9 is a graph of an exemplary vector that does not represent peaks distinctly.

FIG. 9 is a graph of an exemplary vector that does not represent peaks distinctly.

Figure 10:
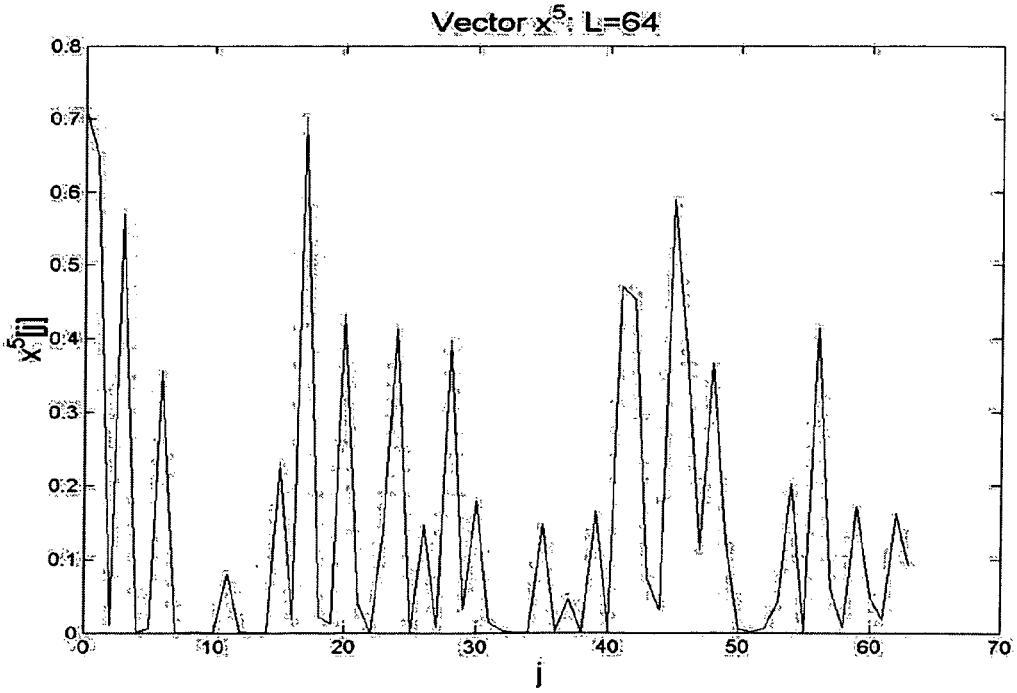
FIG. 10 is a graph of FIG. 9 with distinct peaks created via codeword modification by exponential transform.

FIG. 10 is a graph of FIG. 9 with distinct peaks created by exponential transform.

As an example, see FIG. 9 and FIG. 10. In FIG. 9, a vector which is fairly random and is shown has no distinct peaks. When an exponent p=5 is applied, then FIG. 10 represents the desired peaks better. Similarly, if the original code-vector was that shown in FIG. 10, then an exponent p=1/5=0.2, would provide FIG. 9. The scale factor of course is recomputed since the norm (or energy) in the codevector has changed during the transformation from x to y. In particular, S=Q(||v||)/||y|| is now used for the scale factor. The actual scale factor that is sent Q(||v||) is not changed with the exponent, but the decoder has to compute a different scale factor due to the change in the power in the code-vector.

A codeword may have several exponents applied to it, each providing different results. The method used to calculate the best exponent is to find an exponent such that the histogram (or probability mass function (pmf)) of the values over the code-vector best match that of the actual vector. In order to do this, a variance of the symbol values for both the vector and the code-vector is computed using exponentiation. For example suppose the set of possible exponents is $p_k$, where k is used to index the set of possible exponents, k=0,1, . . . , P−1. Then the normalized second moment about the mean for the codevector resulting from each of possible exponents is computed ($V_k$), and compared to the actual vector (V).

$$V_k = \frac{\left(\frac{1}{L}\sum_{j=0}^{L-1}|x[j]|^{2p_k} - \left(\frac{1}{L}\sum_{j=0}^{L-1}|x[j]|^{p_k}\right)^2\right)}{\frac{1}{L}\sum_{j=0}^{L-1}|x[j]|^{2p_k}}, k = 0, 1, \ldots, P-1$$

$$V = \frac{\left(\frac{1}{L}\sum_{j=0}^{L-1}|v[j]|^2 - \left(\frac{1}{L}\sum_{j=0}^{L-1}|v[j]|\right)^2\right)}{\frac{1}{L}\sum_{j=0}^{L-1}|v[j]|^2}$$

The best exponent is chosen to minimize the difference between $V_k$ and V, and is given by $p_b$, where b is defined as:

$$b = \underset{k}{\operatorname{argmin}}(|V - V_k|).$$

As previously stated, a best match exponent can also be found using an exhaustive search.

Exemplary Codeword Modification Via Combining

Another transformation combines multiple vectors to form a new code-vector. This is essentially a multistage coding, where at each stage a match is found which best matches the most important portion of the vector not yet coded. As an example for two vectors, we first find the best match and then see which portion of the vector is being coded well. This segmentation can be explicitly sent, but this may take too many bits. Therefore, the segmentation is implicitly provided, in one example, by indicating which portion of the vector to use. The remaining portion is then represented using either a random code-vector, or another code-vector from a codebook which represents the remaining components better. Let x be a first code vector, and let w be a second code vector. Let the set T specify the portion of the vector which is considered to be coded using the first code-vector. The cardinality of set T will be between 0 & L, i.e. it will have between 0 and L elements which represent the indices of the vector which are considered to be coded using this first code-vector. A rule is provided for figuring out which components are well represented by the first vector and the rule can use metrics, such as, determining if a potential coefficient is larger than a certain percentage of the maximum coefficient in the first vector. Thus, for any coefficient in the first vector that is within a percentage of the highest coefficient in the first vector, that coefficient will be taken from the first vector, else, that codeword coefficient is taken from the second codeword. Let M be the maximum value in the first code vector x. Then the set T can be defined using the following:

$$T=\{j:x[j]>aM,\ j=0,1,\ldots L-1\},$$

where 'a' is some constant between 0 & 1. For example, if a=0, then any non-0 value is considered to belong to the set T of coded vectors. If a=1−ϵ, then only the maximum value itself is considered to be coded, if ϵ is taken to be sufficiently small. Then given the set T, a set N is the complimentary and remaining set taken from vector w, as follows:

$$N=\{j:x[j]\leqq aM,\ j=0,1,\ldots,L-1\}.$$

Thus, a coefficient of x[j] is taken from x or w depending on the value of aM. Note that N or T can be further split using other similar rules to get more than two vectors. Given T & N as the sets of indices coded using the first codevector (x) and second codevector (w) respectively, a new vector y is defined:

$$y[j]=\begin{cases} S_x x[j], & \text{if } j\in T \\ S_w w[j], & \text{if } j\in N \end{cases},$$

where $S_x$ and $S_w$ are the scale factors for x and w, respectively. Since a scale factor for the entire code-vector is typically sent, which represents a quantized version of the power in the entire vector being coded, a ratio between the two scale factors ($S_w/S_x$) in addition to the scale factor for the entire code-vector needs to be sent in this case. In general, if a vector is created using 'm' codevectors, then 'm' scale factors would have to be sent including the one for the entire vector. For example, for the two vector case, note that, $$\|v\|^2=\frac{1}{L}\sum_{j=0}^{L-1}v^2[j]=\frac{1}{L}\sum_{j\in T}v^2[j]+\frac{1}{L}\sum_{j\in N}v^2[j].$$

Suppose $v_t$ and $v_n$ are defined as the two vectors, then their power may be defined as, $$\|v_t\|^2=\frac{1}{|T|}\sum_{j\in T}v^2[j]$$

$$\|v_n\|^2=\frac{1}{|N|}\sum_{j\in N}v^2[j],$$

where |T| and |N| are the cardinality of the two sets (the number of elements). Given the values for ||v|| (the total power in the vector), and $\|v_n\|$ (the power in the second component of the vector), a decoder can compute, $$\|v_t\|^2=\frac{L\|v\|^2-|N\|v_n\|^2}{|T|}.$$

Thus, if a quantized version of the power in set N is sent ($Q(\|v_n\|)$), and the total power is sent $Q(\|v\|)$, it is sufficient information for the decoder.

It is important to note that, by using the code-vector x itself to perform the segmentation, the encoder avoids having to send any information relating to segmenting because the coefficient selected from each vector x and w is implicit in the rules (e.g., x[j]≧aM). Even in cases when the code-vector index or motion vector corresponding to x is not sent (it is a random code-vector), segmentation of sets T and N can be matched between encoder and decoder by using a random vector with the state of the random vector generator being deterministic based upon information that both the encoder and decoder have. For example, the random vector can be determined by using some combination of the least significant bits (LSB) of data that has been coded and sent to the decoder (such as in the encoded baseband) and then using that to seed a pseudo-random number generator. This way the segmentation can be implicitly controlled even if the actual code-vector is not sent.

This transformation by combining two vectors allows better representation of the vector that is to be coded. The vector w can be from a codebook and an index can be sent to represent it, or it can be random, in which case no additional information needs to be sent. Note that in the example given above, the segmentation is implicit since it is done using a comparison rule on the coefficients (e.g., x[j]≧aM) using vector x, so no information regarding the segmentation needs to be sent. This transformation is useful when the vector to be coded has two different distributions.

Figure 11:
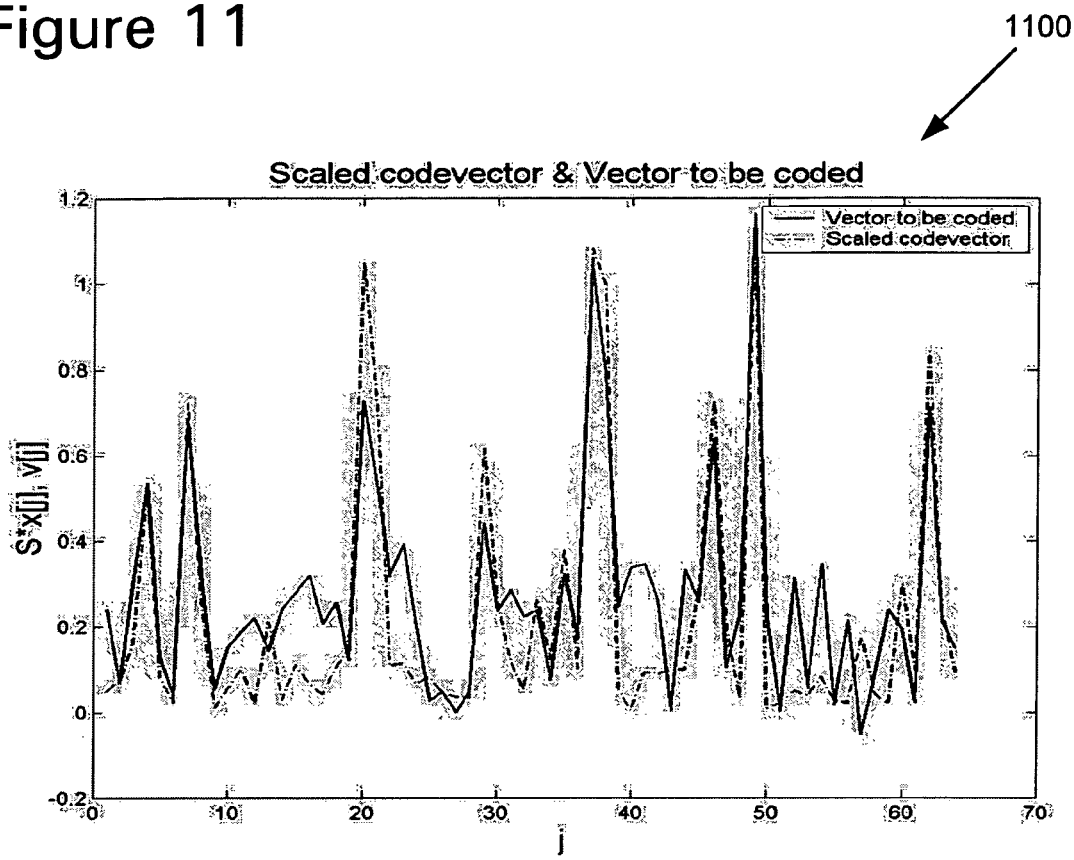
FIG. 11 is a graph of a codeword as compared to the sub-band it is modeling.

FIG. 11 is a graph of a codeword as compared to the sub-band it is modeling. In this example (1100), the code-vector has been chosen to best match the peaks in the vector. However, although the peaks are matched well, the rest of the vector does not have similar power. The remaining portion of the code-vector has much less power relative to the peaks than the actual vector does. This results in noticeable compression artifacts. However, when the portion of v that is well coded by the code-vector is selected out of the first vector and then a second code-vector is applied to the remaining portion, a much better result is obtained.

Figure 12:
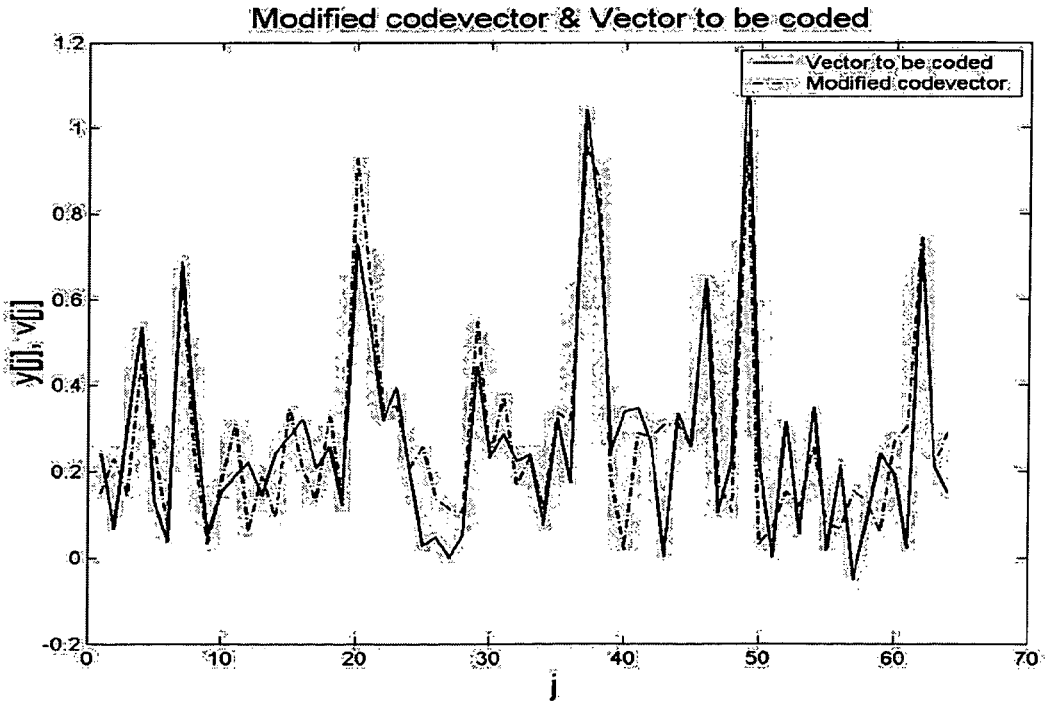
FIG. 12 is a graph of a transformed sub-band codeword as compared to the sub-band it is modeling.

FIG. 12 is a graph of a transformed codeword as compared to the sub-band it is modeling. The modeled sub-band is modeled by a codeword created from two codewords.

Figure 13:
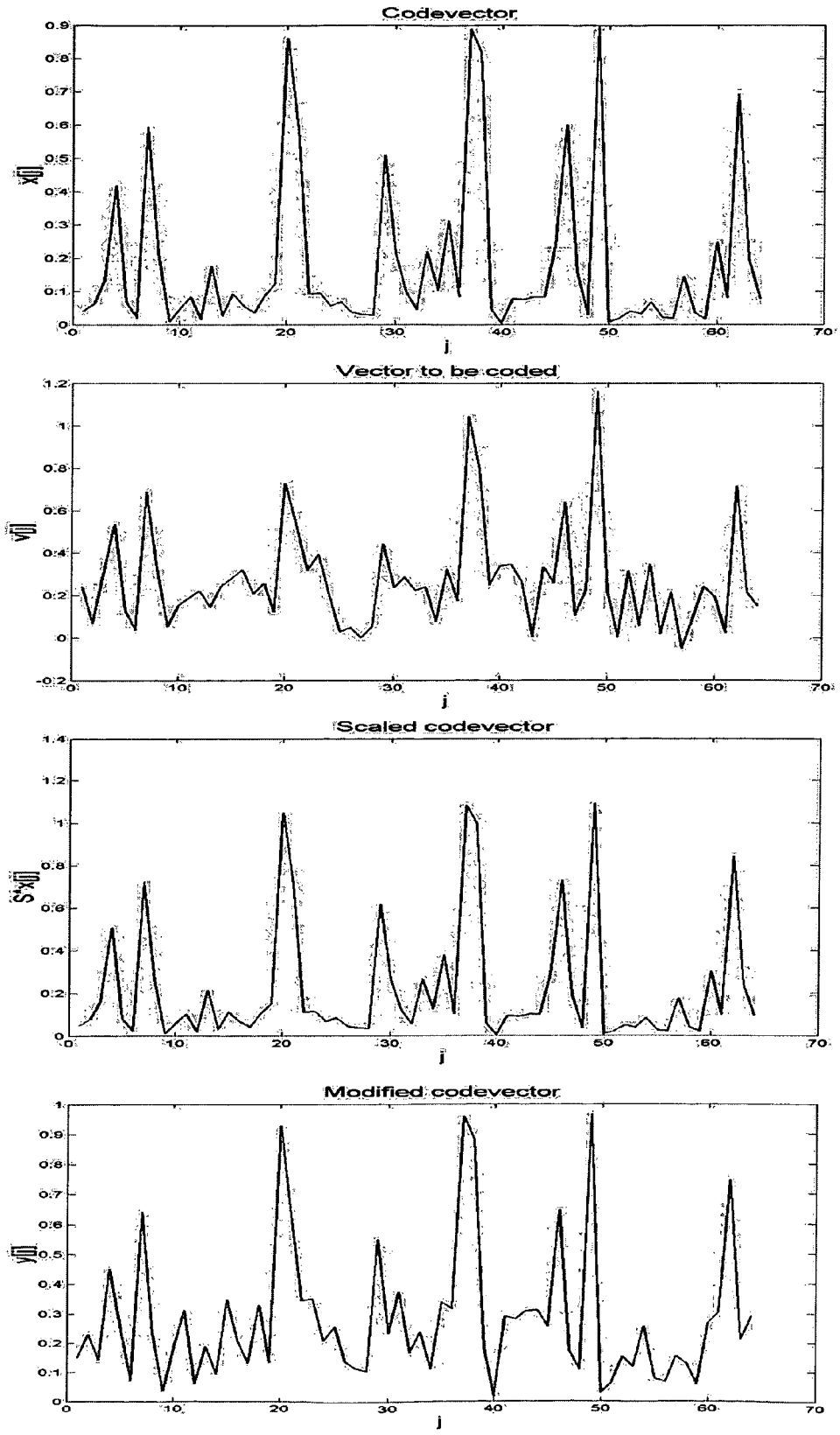
FIG. 13 is a graph of a codeword, a sub-band to be coded by the codeword, a scaled version of the codeword, and a modified version of the codeword.

FIG. 13 is a graph of a codeword, a sub-band to be coded by the codeword, a scaled version of the codeword, and a modified version of the codeword.

Exemplary Codeword Modification Via Selective Operations

An alternate version of the multi codevectors (e.g., multi-codewords) adds the first codevector rather than replacing it for certain selected coefficients. This can be done applying the following equation:

$$y[j] = \begin{cases} S_x x[j], & \text{if } j \in T \\ S_w w[j] + S_x x[j], & \text{if } j \in N \end{cases}$$

Exemplary Enhancement of the Baseband

In this example, a code-vector is combined with a base coding. This is similar to the two vector (or multi vector) approach, except that the first vector x is both the vector being coded and is itself used as one of the two vectors to encode itself. For example, a base coding is modified to include those coefficients where the base coding is working well and better coefficients are taken from the second vector, as before. For each vector (sub-band) that is coded, if a base coding already exists, this base coding then is the first code-vector in the multi-vector scheme, where it is segmented into regions T & N (or more regions). The segmentation (e.g., coefficient selection) can be provided using the same techniques as in the multi code-vector approach.

For example, for each base coding, if there are any coefficients with a value of 0, all of these will then go into set N which are then coded by an enhancement layer (e.g., second vector). Such a method can be used to fill in large spectral holes which often result from coding at very low bitrates. Modifications can include not filling in holes or 'zero' coefficients unless they are larger than some threshold, where the threshold can be defined to be a certain number of Hertz (Hz) or coefficients (multiple zero coefficients). There can also be limitations on not filling of holes that are below a certain frequency. These limitations modify the implicit segmentation rules given above (e.g., x[j]>aM, etc.). For example, if a threshold 'T' on a minimum size of a spectral hole is provided, then this essentially changes the definition of set N to the following:

$$N=\{j:x[j-K]\leqq aM \,\&\&\, x[j-K+1]\leqq aM \,\&\&\, \ldots \,\&\&\, x[j-K+T-1]\leqq aM,\ j=0,1,\ldots,L-1\},$$

for some K between 0, . . . , T−1. So in order for x[j] to be in set N, it has to be part of a group of T consecutive coefficients, all of which have a value less than or equal to (aM). This can be computed in two steps, first computing for each coefficient whether its value is less than the threshold, and then grouping them together to see if they meet the 'consecutive' requirements. For a true spectral hole of size T, a=0. Other conditions such as minimum frequency constraints add the additional constraint that in order to belong to set N, $j>T_{minfreq}$.

The above rule provides a filter that requires that multiple coefficients in a row (e.g., T consecutive coefficients) satisfy the condition x[j]≦aM, before the rule signals replacing the coefficients with values from the second vector.

Another modification that may need to be made is due to the fact that base coding also codes the channels after applying a channel transform. Thus, after a channel transform the base coding and enhancement coding might have different channel groupings. So, instead of just looking at the base coding for the particular channel upon which the enhancements is applied, the segmentation might look at more than the base coding channel. This again modifies the segmentation constraint. For example, suppose channels 0 and 1 are jointly coded. Then the rule to apply the enhancement is changed to the following. In order to apply the enhancement, the spectral hole has to be present in both the baseband coded channels since both the coded channels contribute to both the actual channels.

Exemplary Optimization of Segmentation of Sub-Bands

Good frequency segmentation is important to the quality of encoding spectral data. Segmentation involves breaking the spectral data into units called sub-bands or vectors. A simple segmentation is to uniformly split the spectrum into a desired number of homogeneous segments or sub-bands. Homogeneous segmentation may be suboptimal. There may be regions of the spectrum that can be represented with larger sub-band sizes, and other regions are better represented with smaller sub-band sizes. Various features are described for providing spectral data intensity dependent segmentation. Finer segmentation is provided for regions of greater spectral variance and coarser segmentation is provided for more homogeneous regions. For example, a default or initial segmentation is provided initially, and an optimization or subsequent configuration varies the segmentation based on an intensity of spectral data variance.

Exemplary Default Segmentation

Spectral data is initially segmented into sub-bands. Optionally, an initial segmentation may be varied to produce an optimal or subsequent segmentation. Two such initial or default segmentations are called a uniform split segmentation and a non-uniform split configuration. These or other sub-band configurations can be provided initially or by default. Optionally, the initial or default configuration may be reconfigured to provide a subsequent sub-band configuration.

Given spectral data of L spectral coefficients, a uniform split segmentation of M sub-bands of data is identified with the following equation:

$$s[j] = \text{round}\left(\frac{jL}{M}\right), \quad j = 0, 1, \ldots, M-1, M$$

For example, if the L spectral coefficients are labeled as points as 0, 1, . . . , L−1, then the M sub-bands start at the s[j] coefficients in the spectral data. Thus, the 'j'th sub-band has coefficients from s[j] to s[j+1]−1, j=0, 1, . . . , M−1, with a sub-band size of s[j+1]−s[j] coefficients.

The non-uniform split segmentation is done in a similar way, except that sub-band multipliers are provided. A sub-band multiplier is defined for each of the M sub-bands, a[j], j=0, 1, . . . , M−1. Further, a cumulative sub-band multiplier is provide as follows:

$$b[j] = \sum_{k=0}^{j-1} a[j], \quad j = 0, 1, \ldots, M$$

The starting point for the sub-bands in the non-uniform split configuration case is defined as:

$$s[j] = \text{round}\left(\frac{b[j]L}{b[M]}\right), \quad j = 0, 1, \ldots, M-1, M$$

Again, the 'j'th sub-band includes coefficients from s[j] to s[j+1]−1, where j=0, 1, . . . , M−1, with a sub-band size of s[j+1]−s[j] coefficients. The non-uniform configuration has sub-band sizes which increase with frequency, but it can be any configuration. Further, if desirable, it can be predetermined, so that no additional information needs to be sent to describe it. For the default non-uniform case, an example of sub-band multipliers is provided as follows:

$$a=\{1,1,2,2,4,4,4,4,8,8,8,8,8,8,8,8,\ldots\}$$

Thus, the default non-uniform band-size multiplier is a split configuration where the band sizes are monotonically non-decreasing (the first few sub-bands are smaller, and the higher frequency sub-bands are larger). The higher frequency sub-bands often have less variation to begin with, so fewer larger sub-bands can capture the scale and shape of the band. Additionally, the higher frequency sub-bands have less importance in the overall perceptual distortion because they have less energy and are perceptually less important to human ears. Notice that the uniform split can also be explained using sub-band multipliers, except that a[j]=1 for all j.

Although a default or initial segmentation is often sufficient for coding spectral data, and in fact the non-uniform scheme can handle a large percentage of cases, there are signals which benefit from an optimized segmentation. For such signals, a segmentation is defined that is similar to the non-uniform case, except that the band multipliers are arbitrary instead of fixed. The arbitrary band multipliers reflect the splits and merges of sub-bands. In one example, an encoder signals the decoder with a first bit indicating whether the segmentation is fixed (e.g., default) or variable (e.g., optimized or altered). A second bit is provided for signaling whether the initial segmentation is uniform split or an non-uniform split.

Exemplary Optimized Segmentation

Starting with a default segmentation (such as a uniform or non-uniform segmentation), sub-bands are split or merged to obtain an optimized or subsequent segmentation. A decision is made to split a sub-band into two sub-bands, or to merge two sub-bands into one sub-band. A decision to split or merge can be based on various characteristics of the spectral data within an initial sub-band, such as a measurement of intensity of change over a sub-band. In one example, a decision is made to split or merge based on sub-band spectral data characteristics such as tonality or spectral flatness in a sub-band.

In one such example, if the ratio of energy is similar between two sub-bands, and if at least one of the bands is non-tonal, then the two adjacent sub-bands are merged. This is because a single shape vector (e.g., codeword) and a scale factor will likely be sufficient to represent the two sub-bands. One example of such a ratio of energy is provided as follows:

$$\frac{\min(E_0, E_1)}{\max(E_0, E_1)} \geq (1-a)\ \&\&\ (Tonality_0 < T \| Tonality_1 < T),$$

In this example, $E_0$ is the energy in sub-band 0, $E_1$ is the energy in an adjacent sub-band 1, 'a' is a constant threshold value (typically in the range 0<a<1) and T is a tonality comparison metric. The tonality measure (e.g., $Tonality_0$) in a sub-band can be obtained using various methods analyzing the spectrum.

Similarly, if splitting a single sub-band into two sub-bands creates two sub-bands with dissimilar energy, then the split should be made. Or, if splitting a sub-band creates two sub-bands that are strongly tonal with different shape characteristics, then the sub-band should be split. For example, such a condition is defined as follows:

$$\frac{\max(E_0, E_1)}{\min(E_0, E_1)} \geq (1+b) \| (Tonality_0 > T\ \&\&\ Tonality_1 > T\ \&\&\ \text{Different shape}),$$

where 'b' is a constant greater than zero. For example, two sub-bands may be defined to have different shape if the shape match significantly improves when the sub-band is split. In one example, a shape match is considered better if the two split sub-bands have a much lower means-square Euclidean difference (MSE) match after the split, as compared to the match before the split. For example, a sub-band is compared to a plural codewords to determine a best match codeword for the single sub-band. Then the sub-band is split into two bands, each sub-band compared to (half) codewords to find a best match for each split sub-band. The MSE of the two sub-bands matches is compared to the MSE of the single sub-band match, and a significantly improved match indicates a improvement worth the extra overhead of encoding a split. For example, if an MSE improves by 20% or more, the split is considered efficient. In this example, although not required, the shape match becomes relevant if both the split sub-bands are tonal.

In one example, an algorithm is run repeatedly until no additional sub-bands are split or merged in a present iteration. It may be beneficial to tag sub-bands as split, merge, or original in order to reduce the chance of an infinite loop. For example, if a sub-band is marked as a split sub-band, then it will not be merged back with a sub-band it was split from. A block which is marked as merged, will not be split into the same configuration.

Various metrics are utilized for computing tonality, energy, or different shape. A motion vector and a scale metric may be used to encode an extended sub-band. If by splitting a sub-band into two sub-bands creates a significantly different energy in the scale factor (e.g., ≧(1+b), where b is 0.2-0.5), then the sub-band can be split. In one example, tonality is computed in the fast fourier transform (FFT) domain. For example, an input signal is divided into fixed blocks of 256 samples, and the FFT is run on three adjacent FFT blocks. A time average is performed on three adjacent FFTs outputs to get a time averaged FFT output for the current block. A median filter is run over the three time averaged FFT outputs to get a baseline. If a coefficient is above a certain threshold above the baseline, then the coefficient is classified as tonal, and the percentage that it is above the baseline is a measure of the tonality. If the coefficient is below the threshold, then it is not tonal and the measure of tonality is 0. The tonality for a particular time frequency tile is found by mapping the dimensions of the tile to the FFT blocks and accumulating the tonality measure over the block. The threshold that a coefficient has to be over the baseline can be defined to be either an absolute threshold, a ratio relative to the baseline, or a ratio relative to the variance of the baseline. For example, if the coefficient is above one local standard deviation from the baseline (median filtered, time averaged), it can be classified as being tonal. In such a case, the corresponding translated sub-band in the MLT representing the tonal FFT blocks is labeled tonal, and may be split. The discussion is concerned with the magnitude of the FFT as opposed to the phase. With respect to the MSE metric on different shapes, a metric of much lower MSE may vary substantially on the bit rate. For example, with higher bit rates, if the MSE goes down by approximately 20%, then a split determination may make sense. However, at lower bit rates the split decision may occur at a 50% lower MSE.

Exemplary Variable Band Multiplier and Coding

After sub-bands are split and or merged, the ratio between the original smallest sub-band size and the new smallest sub-band size is computed. A ratio is defined as minRatioBandSize=max(1, original smallest sub-band size/new smallest sub-band size). Then, the optimized sub-band with the smallest size (e.g., number of coefficients in the sub-band) is assigned a sub-band multiplier of 1, and the other sub-band sizes have a band multiplier set as round (this sub-band size/smallest sub-band size). Thus, sub-band multipliers are integers greater than or equal to 1, and minRatioBandSize is also an integer greater than or equal to 1. The sub-band multipliers are coded by essentially coding a difference between the expected sub-band multiplier and the optimized sub-band multiplier using a table-less variable length code. A difference of 0 is coded with 1 bit, a difference which is one of the 15 smallest possible differences excluding 0 are coded with 5 bits, and the rest of the differences are coded using a table-less code.

As an example, consider the following case where the sub-band sizes for a default non-uniform case are given as shown in Table 4.

TABLE 4

| | | | | | | | |
|---|---|---|---|---|---|---|---|
| Bandsizes: | 4 | 4 | 8 | 8 | 16 | 16 | 16 |
| Band multipliers: | 1 | 1 | 2 | 2 | 4 | 4 | 4 |

Assume further, that after splitting/merging, the following optimized sub-band configuration is created as shown in Table 5.

TABLE 5

| | | | | | | | |
|---|---|---|---|---|---|---|---|
| Bandsizes: | 2 | 4 | 10 | 24 | 8 | 8 | 16 |

Figure 14:
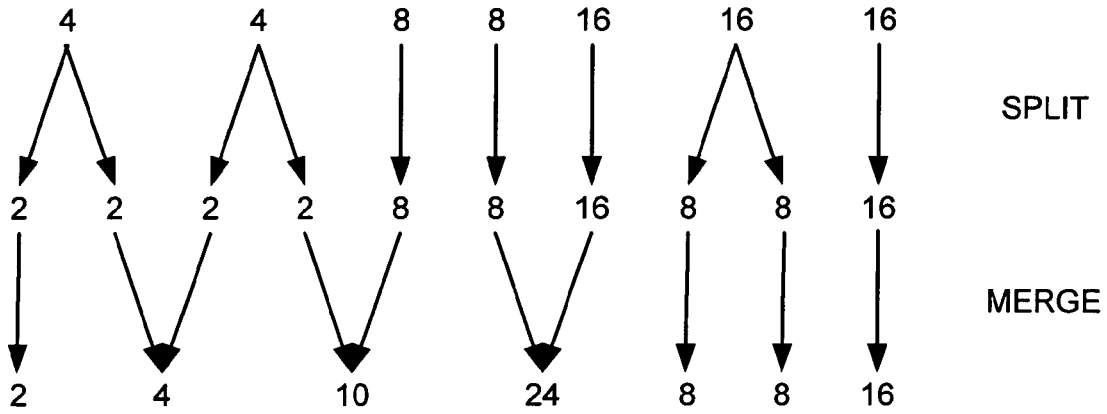
FIG. 14 is a diagram of an exemplary series of split and merge sub-band size transformations.

FIG. 14 is a diagram of an exemplary series of sub-band size transformations. For example, the sub-band sizes in Table 5 can be attained from the Table 4 via the transformations of FIG. 14.

Using the above formula for minRatioBandSize=max(1, 4/2)=2, the minimum ratio sub-band size of 2 is provided, and the values for band size multipliers can be obtained as shown in Table 6.

TABLE 6

| | | | | | | | |
|---|---|---|---|---|---|---|---|
| Bandsizes: | 2 | 4 | 10 | 24 | 8 | 8 | 16 |
| Band Multiplier: | 1 | 2 | 5 | 12 | 4 | 4 | 8 |
| minRatioBandSize: | 2 | | | | | | |

A method is used to calculate the expected sub-band multiplier. First, assume that blocks which are not split or merged should have the default band size multiplier (expected band size multiplier==actual band size multiplier). This saves bits since only changes from the expected band size multiplier need to be encoded. Further, the smaller the modification is from the default band configuration, fewer bits are needed to encode the configuration. Otherwise, the expected band multiplier is computed at the decoder using the following logic.

See which sub-band in the default configuration we are currently decoding by looking at the starting point of the actual band and comparing with the starting and ending points of the bands in the default band configuration.

The expected band multiplier is calculated by taking the number of coefficients left within the band in the default configuration and dividing by the smallest block (sub-band) size in the actual configuration.

For example, let $s_d[j]$ be the starting position of the 'j'th band in the default band configuration, let $s_a[j]$ be the starting position of the 'j'th band in the actual band configuration, let $m_d$ be the minimum band size in the default case, and let $m_a$ be the minimum band size in the actual case. Then, calculate the following, $$r=\max(1, m_d/m_a)$$

$$a[j]=(s_a[j+1]s_a[j])/m_a.$$

where 'r' is the minRatioBandSize, and a[j] is the band multiplier for the 'j'th band. To calculate the expected multiplier for the 'j'th band, first compute 'i', the index of the default band configuration which contains the starting position of the actual band. Then, compute $a_{expected}[j]$ to be the expected multiplier of the 'j'th band. This can be computed as follows, $$s_d[i] \leq s_a[j] < s_d[i+1]$$

$$a_{expected}[j]=(s_d[i+1]-s_a[j])/m_a.$$

Note that if a band is not split or merged, then the expected band multiplier will be the same as the actual one. Also, so long as $s_d[i+1]$ is the same as $s_a[j+1]$, then the expected band multiplier will be the same as the actual one.

Continuing with the example, a default sub-band configuration is shown in Table 7.

TABLE 7

| | | | | | | | |
|---|---|---|---|---|---|---|---|
| Bandsizes | 4 | 4 | 8 | 8 | 16 | 16 | 16 |
| Band index | 0 | 1 | 2 | 3 | 4 | 5 | 6 |
| Startpoint | 0 | 4 | 8 | 16 | 24 | 40 | 56 |
| Endpoint | 4 | 8 | 16 | 24 | 40 | 56 | 72 |

The actual or optimized sub-bands as they map to the default band configuration is shown in Table 8.

TABLE 8

| | | | | | | | |
|---|---|---|---|---|---|---|---|
| Bandsizes | 2 | 4 | 10 | 24 | 8 | 8 | 16 |
| Band Multiplier | 1 | 2 | 5 | 12 | 4 | 4 | 8 |
| Startpoint | 0 | 2 | 6 | 16 | 40 | 48 | 56 |
| Default Band Index | 0 | 0 | 1 | 3 | 5 | 5 | 6 |
| Coefficients Left | 4 | 2 | 2 | 16 | 16 | 8 | 16 |
| ExpectedBandMulti | 2 | 1 | 1 | 8 | 8 | 4 | 8 |
| Difference | −1 | 1 | 4 | 4 | −4 | 0 | 0 |

The Default Band Index is the value of 'i' for a given j. Coefficients Left is $s_d[i+1]-s_a[j]$. The Expected Band Multiplier is $a_{expected}[j]$, and Band Multiplier is a[j]. Again, note that any sub-band which is not split or merged will always have a difference of 0. The coding will code the "Difference" value for each sub-band and the minRatioBandSize ('r') for the configuration using a variable length code for each. The use of minRatioBandSize allows coding a band configuration in which the smallest bands are smaller than the bands in the default configuration.

Computing Environment

Figure 15:
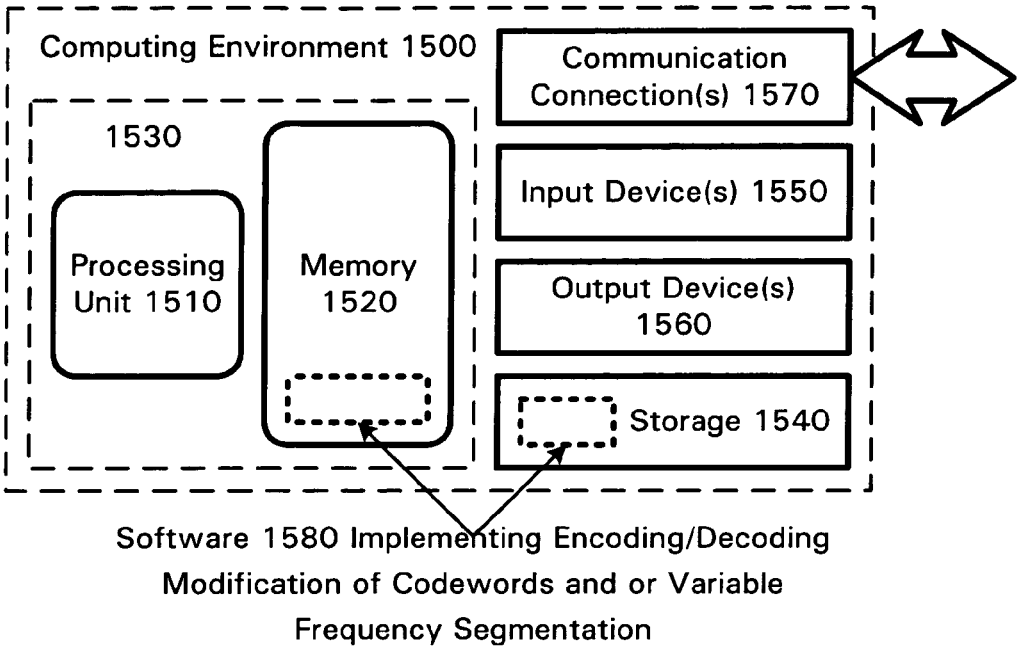
FIG. 15 is a block diagram of a suitable computing environment for implementing the audio encoder/decoder of FIG. 1 or 2.

FIG. 15 illustrates a generalized example of a suitable computing environment (1500) in which the illustrative embodiments may be implemented. The computing environment (1500) is not intended to suggest any limitation as to scope of use or functionality of the invention, as the present invention may be implemented in diverse general-purpose or special-purpose computing environments.

With reference to FIG. 15, the computing environment (1500) includes at least one processing unit (1510) and memory (1520). In FIG. 15, this most basic configuration (1530) is included within a dashed line. The processing unit (1510) executes computer-executable instructions and may be a real or a virtual processor. In a multi-processing system, multiple processing units execute computer-executable instructions to increase processing power. The memory (1520) may be volatile memory (e.g., registers, cache, RAM), non-volatile memory (e.g., ROM, EEPROM, flash memory, etc.), or some combination of the two. The memory (1520) stores software (1580) implementing an audio encoder and or decoder.

A computing environment may have additional features. For example, the computing environment (1500) includes storage (1540), one or more input devices (1550), one or more output devices (1560), and one or more communication connections (1570). An interconnection mechanism (not shown) such as a bus, controller, or network interconnects the components of the computing environment (1500). Typically, operating system software (not shown) provides an operating environment for other software executing in the computing environment (1500), and coordinates activities of the components of the computing environment (1500).

The storage (1540) may be removable or non-removable, and includes magnetic disks, magnetic tapes or cassettes, CD-ROMs, CD-RWs, DVDs, or any other medium which can be used to store information and which can be accessed within the computing environment (1500). The storage (1540) stores instructions for the software (1580) implementing the audio encoder and or decoder.

The input device(s) (1550) may be a touch input device such as a keyboard, mouse, pen, or trackball, a voice input device, a scanning device, or another device that provides input to the computing environment (1500). For audio, the input device(s) (1550) may be a sound card or similar device that accepts audio input in analog or digital form. The output device(s) (1560) may be a display, printer, speaker, or another device that provides output from the computing environment (1500).

The communication connection(s) (1570) enable communication over a communication medium to another computing entity. The communication medium conveys information such as computer-executable instructions, compressed audio or video information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (1500), computer-readable media include memory (1520), storage (1540), communication media, and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "determine," "get," "adjust," and "apply" to describe computer operations in a computing environment. These terms are high-level abstractions for operations performed by a computer, and should not be confused with acts performed by a human being. The actual computer operations corresponding to these terms vary depending on implementation.

In view of the many possible embodiments to which the principles of our invention may be applied, we claim as our invention all such embodiments as may come within the scope and spirit of the following claims and equivalents thereto.

We claim:

1. An audio encoding method, comprising:

transforming an input audio signal into a set of spectral coefficients;

coding a baseband portion of the set of spectral coefficients in the output bitstream;

dividing an extended band of the spectral coefficients into plural sub-bands;

scaling the plural sub-bands in the extended band;

transforming at least one codeword from a library of plural codewords using a codeword transform;

comparing the set of spectral coefficients of a sub-band to at least one transformed codewords from the library;

coding the spectral coefficients of the sub-band in an output bitstream comprising coding an identifier of one or more codewords from the library and a codeword transform identifier.

2. The encoder of claim 1 further comprising:

comparing the spectral coefficients of the sub-band to at least one codeword from the library that has not been transformed, wherein the library comprises plural codewords from the baseband portion.

3. The audio encoding method of claim 2, further comprising:

determining that a part of the baseband portion poorly represents the input audio signal;

enhancing the part of the baseband portion;

the enhancement comprising, from the poorly represented part of the baseband portion, selecting coefficients that represent the input audio signal well, and from a second codeword, selecting all other coefficients; and coding the enhancement comprising an identifier of the second codeword, an identifier of the poorly represented part, and a rule for selecting coefficients.

4. The audio encoding method of claim 3 wherein the second codeword is obtained from a noise codebook or random number generator.

5. The audio encoding method of claim 1 wherein available codeword transforms for transforming at least one codeword from the library comprise one or more of the following transforms:

applying an exponent to each coefficient of a codeword;

negating each coefficient of a codeword; or reversing the order of coefficients in a codeword.

6. The audio encoding method of claim 1 wherein transforming at least one codeword from the library comprises creating a codeword with coefficients from two or more codewords comprising:

from all but the final codeword, selecting coefficients that satisfy a rule;

from a final codeword, providing the other coefficients.

7. The audio encoding method of claim 1 wherein the library further comprises codewords from a noise codebook or a codeword populated using a determinatively seeded random number generator.

8. The audio encoding method of claim 1 wherein coding the sub-band includes providing an identifier of two or more codewords and the codeword transform identifier comprises at least one of an exponent indication, a sign indication, a direction indication, or an ordering of codeword identifiers in the output bitstream, the ordering indicating an implicit selection of coefficients.

9. The audio encoding method of claim 1 wherein coding the spectral coefficients of the sub-band in the output bitstream includes an identifier of two or more codewords and the codeword transform identifier is an identifier of an explicit rule for selection of coefficients from the two or more codewords.

10. The audio encoding method of claim 1 wherein the compared at least one transformed codeword from the library is two or more codewords created using an exponential transformation of a closest matching codeword from the library.

11. The audio encoding method of claim 10 wherein the closest matching codeword from the library is identified using a least-mean square comparison and the two or more codewords created from the exponential transformation are compared using a probability mass function.

12. The audio encoding method of claim 1 wherein the compared codewords comprise plural codewords from the library and comparing the spectral coefficients of the sub-band to the at least one transformed codeword from the library comprises an exhaustive search on the codewords of the library and transformations thereof comprising negation, reverse direction, and exponential transformations using two or more exponents.

13. The audio encoding method of claim 1 wherein transforming at least one codeword from the library comprises creating a codeword with coefficients from two or more codewords comprising:

from a first codeword, selecting coefficients that satisfy a rule; and for coefficients in the first codeword that do not satisfy the rule, performing a mathematical operation to create other coefficients, the mathematical operation comprising an operator and plural operands, a first operand being a coefficient from the first codeword that does not satisfy the rule, and a second operand being a coefficient obtained from a second codeword.

14. The audio encoding method of claim 1, further comprising pre-selecting codewords before comparing the spectral coefficients of the sub-band to codewords, the pre-selection comprising:

creating an envelope comprising running a weighted average function on an audio signal; and determining the pre-selected codewords by comparing the envelope to the spectral coefficients of the sub-band.

15. The audio encoding method of claim 14 wherein comparing the envelope to the spectral coefficients of the sub-band further comprises:

transforming the envelope using one or more transforms comprising a negation transform, a reverse transform, or an exponential transform; and wherein comparing the envelope to the spectral coefficients of the sub-band comprises determining a Euclidean distance.

16. An audio decoding method comprising:

decoding encoded spectral coefficients in a bitstream;

decoding spectral coefficients of one or more encoded sub-bands in the bitstream comprising, determining one or more codeword identifiers for each sub-band, obtaining the one or more determined codewords for each sub-band, and for at least one sub-band, determining a codeword transformation rule based on a codeword transformation rule identifier in the bitstream, for the at least one sub-band, transforming a codeword obtained for the sub-band using the codeword transformation rule to produce the spectral coefficients of the respective sub-band;

reconstructing an audio signal based on the decoded spectral coefficients; and playing the audio signal.

17. The audio decoding method of claim 16 wherein the determined transformation rule comprises one or more of the following transforms:

applying an exponent to each coefficient of a codeword;

negating each coefficient of a codeword; or reversing the order of coefficients in a codeword.

18. The audio decoding method of claim 16 wherein the determined codeword transformation rule creates a codeword from two or more codewords comprising:

from all but the final codeword, selecting coefficients that satisfy a rule; and from a final codeword, providing the other coefficients.

19. An audio encoder device comprising:

a transform for transforming an input audio signal block into spectral coefficients;

a base coder for coding values of a baseband portion of spectral coefficients into a bitstream;

a divider for dividing a portion of spectral coefficients into sub-bands;

a scaler for scaling sub-bands;

a comparer for comparing spectral coefficients of the sub-bands to codewords from a library of codewords;

an extended band coder for coding spectral coefficients of the sub-bands into the bitstream, wherein a coding of the spectral coefficients for a sub-band comprises an identifier of a codeword and a exponent for transforming the identified codeword.

* * * * *